US010625114B2

(12) United States Patent
Ercanbrack

(10) Patent No.: US 10,625,114 B2
(45) Date of Patent: Apr. 21, 2020

(54) ELLIPTICAL AND STATIONARY BICYCLE APPARATUS INCLUDING ROW FUNCTIONALITY

(71) Applicant: ICON Health & Fitness, Inc., Logan, UT (US)

(72) Inventor: Gaylen Ercanbrack, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 89 days.

(21) Appl. No.: 15/787,466

(22) Filed: Oct. 18, 2017

(65) Prior Publication Data

US 2018/0117393 A1 May 3, 2018

Related U.S. Application Data

(60) Provisional application No. 62/416,030, filed on Nov. 1, 2016.

(51) Int. Cl.

| | |
|---|---|
| ***A63B 22/00*** | (2006.01) |
| ***A63B 21/22*** | (2006.01) |
| ***A63B 21/00*** | (2006.01) |
| ***A63B 22/06*** | (2006.01) |
| ***A63B 22/20*** | (2006.01) |
| ***A63B 23/035*** | (2006.01) |

(52) U.S. Cl.

CPC .... *A63B 22/0046* (2013.01); *A63B 21/00192* (2013.01); *A63B 21/153* (2013.01); *A63B 21/225* (2013.01); *A63B 21/4035* (2015.10); *A63B 22/001* (2013.01); *A63B 22/0076* (2013.01); *A63B 22/0605* (2013.01); *A63B 22/0664* (2013.01); *A63B 22/203* (2013.01); *A63B 23/03575* (2013.01); *A63B 2022/0079* (2013.01); *A63B 2022/0652* (2013.01); *A63B 2022/0676* (2013.01); *A63B 2208/0204* (2013.01); *A63B 2208/0233* (2013.01); *A63B 2208/0238* (2013.01); *A63B 2225/09* (2013.01); *A63B 2225/102* (2013.01)

(58) Field of Classification Search

CPC ..... A63B 22/0046; A63B 22/0664; A63B 22/203; A63B 22/0605; A63B 22/001; A63B 22/0076; A63B 21/00192; A63B 21/225; A63B 21/153; A63B 21/4035; A63B 23/03575; A63B 2208/0204; A63B 2208/0233; A63B 2208/0238; A63B 2022/0079; A63B 2022/0676; A63B 2022/0652; A63B 2225/09; A63B 2225/102

See application file for complete search history.

(56) References Cited

U.S. PATENT DOCUMENTS

| | | | |
|---|---|---|---|
| 105,055 | A | 7/1870 | Dulij |
| 1,015,071 | A | 1/1912 | Reach |
| 1,186,283 | A | 6/1916 | Coddington |

(Continued)

*Primary Examiner* — Loan B Jimenez
*Assistant Examiner* — Kathleen Vermillera
(74) *Attorney, Agent, or Firm* — Ray Quinney & Nebeker

(57) ABSTRACT

An exercise machine includes a frame, a seat track of the frame, a seat movably attached to the seat track of the frame, at least one resistance mechanism connected to the frame, a pull cable in communication with the resistance mechanism, a crank assembly in communication with the resistance mechanism, a first swing arm connected to the frame, and a second swing arm connected to the frame.

18 Claims, 7 Drawing Sheets

(56) References Cited

U.S. PATENT DOCUMENTS 1,205,426 A 11/1916 Barnhill
1,577,866 A 3/1926 Mossberg
1,969,901 A 8/1934 Pilates
2,041,445 A 5/1936 Warren
2,079,594 A 5/1937 Hall
2,145,940 A 2/1939 Marlowe
2,209,034 A 7/1940 Rene
2,261,155 A 11/1941 Simon
2,470,544 A 5/1949 Bell
2,470,816 A 5/1949 Roosevelt
2,544,106 A 3/1951 Ray
2,553,912 A 5/1951 Gervais
2,607,816 A 8/1952 Ryder
2,642,288 A 6/1953 Bell
2,685,325 A 8/1954 Webster
2,714,507 A 8/1955 Goodrich
2,771,968 A 11/1956 Mercier
2,855,200 A 10/1958 Blickman
2,924,456 A 2/1960 Miller
2,986,937 A 6/1961 Chapman
3,008,265 A 11/1961 Converse
3,100,640 A 8/1963 Weitzel
3,103,357 A 9/1963 Berne
3,190,675 A 6/1965 Tang
3,205,888 A 9/1965 Stroop
3,227,447 A 1/1966 Baker
3,312,466 A 4/1967 Melchiona
3,316,898 A 5/1967 Brown
3,323,366 A 6/1967 De Lorme et al.
3,394,934 A 7/1968 Petros
3,414,260 A 12/1968 Gust
3,425,523 A 2/1969 Robinette
3,430,084 A 2/1969 Hall
3,432,164 A 3/1969 Deeks
3,446,503 A 5/1969 Lawton
3,465,592 A 9/1969 Perrine
3,473,843 A 10/1969 Hart
3,501,140 A 3/1970 Eichorn
3,506,311 A 4/1970 Nobach
3,511,500 A 5/1970 Dunn
3,528,653 A 9/1970 Stuckenschneider et al.
3,529,474 A 9/1970 Olson
3,563,541 A 2/1971 Sanquist
3,572,758 A 3/1971 Lee
3,589,193 A 6/1971 Thornton
3,621,948 A 11/1971 Dimick
3,622,179 A 11/1971 Pfersick
3,638,941 A 2/1972 Kulkens
3,640,530 A 2/1972 Henson et al.
3,647,209 A 3/1972 La Lanne
3,664,666 A 5/1972 Lloyd
3,677,553 A 7/1972 Moore
3,686,776 A 8/1972 Dahl
3,709,487 A 1/1973 Walker
3,738,661 A 6/1973 Moller
3,756,595 A 9/1973 Hague
3,759,511 A 9/1973 Zinkin
3,760,905 A 9/1973 Dower
3,767,195 A 10/1973 Dimick
3,770,267 A 11/1973 McCarthy
3,802,698 A 4/1974 Burian et al.
3,809,393 A 5/1974 Jones
3,820,617 A 6/1974 Groff
3,822,599 A 7/1974 Brentham
3,824,994 A 7/1974 Soderberg, Sr.
3,833,216 A 9/1974 Philbin
3,834,696 A 9/1974 Spector
3,851,874 A 12/1974 Wilkin
3,858,873 A 1/1975 Jones
3,863,933 A 2/1975 Tredway
3,874,657 A 4/1975 Niebojewski
3,892,404 A 7/1975 Martucci
3,895,825 A 7/1975 Sink
3,903,613 A 9/1975 Bisberg
3,941,377 A 3/1976 Lie
3,957,266 A 5/1976 Rice
3,966,201 A 6/1976 Mester
3,967,503 A 7/1976 Svensson
3,970,302 A 7/1976 McFee
3,976,058 A 8/1976 Tidwell
3,990,136 A 11/1976 Hishida
3,998,454 A 12/1976 Jones
4,007,927 A 2/1977 Proctor
4,020,795 A 5/1977 Marks
4,023,466 A 5/1977 Strassheimer
4,026,545 A 5/1977 Schonenberger
4,027,881 A 6/1977 Hufenus
4,043,552 A 8/1977 Kerkonian
4,045,096 A 8/1977 Lidov
4,049,262 A 9/1977 Cunningham, Jr.
4,072,309 A 2/1978 Wilson
4,077,278 A 3/1978 Combastet
4,082,267 A 4/1978 Flavell
4,093,196 A 6/1978 Bauer
4,101,124 A 7/1978 Mahnke
4,101,143 A 7/1978 Sieber
4,114,873 A 9/1978 Jones
4,131,266 A 12/1978 Carter
4,138,286 A 2/1979 Chevrolat et al.
4,140,312 A 2/1979 Buchmann
4,148,478 A 4/1979 Moyski et al.
4,151,988 A 5/1979 Nabinger
4,157,179 A 6/1979 Ecklor, Jr.
4,170,351 A 10/1979 Ozbey
4,171,805 A 10/1979 Abbott
4,176,836 A 12/1979 Coyle
4,179,121 A 12/1979 Kelmanski
4,188,030 A 2/1980 Hooper
4,208,921 A 6/1980 Keyes
4,222,376 A 9/1980 Praprotnik
4,235,437 A 11/1980 Ruis et al.
4,240,627 A 12/1980 Brentham
4,258,913 A 3/1981 Brentham
4,274,631 A 6/1981 Hayazaki
4,278,095 A 7/1981 Lapeyre
4,278,249 A 7/1981 Forrest
4,286,696 A 9/1981 Szymski et al.
4,290,601 A 9/1981 Mittelstadt
4,291,872 A 9/1981 Brilando et al.
4,300,760 A 11/1981 Bobroff
4,302,008 A 11/1981 Lard
4,316,609 A 2/1982 Silberman
4,319,747 A 3/1982 Rogers
4,340,214 A 7/1982 Schuetzer
4,354,675 A 10/1982 Barclay et al.
4,369,966 A 1/1983 Silberman et al.
4,390,177 A 6/1983 Biran et al.
4,411,342 A 10/1983 Katsumori et al.
4,417,574 A 11/1983 Talonn et al.
4,421,307 A 12/1983 Cunnington et al.
4,452,448 A 6/1984 Ausherman
4,462,252 A 7/1984 Smidt et al.
4,477,071 A 10/1984 Brown et al.
4,480,832 A 11/1984 Bulmash
4,492,375 A 1/1985 Connelly
4,496,147 A 1/1985 DeCloux et al.
4,503,925 A 3/1985 Palmer et al.
4,505,473 A 3/1985 Pro
4,507,120 A 3/1985 Paradis
4,509,742 A 4/1985 Cones
4,511,137 A 4/1985 Jones
4,512,566 A 4/1985 Bicocchi
4,512,567 A 4/1985 Phillips
4,519,604 A 5/1985 Arzounian
4,521,013 A 6/1985 Dofel
4,531,729 A 7/1985 Wrinkle
4,531,731 A 7/1985 Law
4,533,136 A 8/1985 Smith et al.
4,549,733 A 10/1985 Salyer
4,558,696 A 12/1985 Eiserman
4,563,001 A 1/1986 Terauds
4,564,193 A 1/1986 Stewart
4,566,692 A 1/1986 Brentham
4,571,682 A 2/1986 Silverman et al.

(56) References Cited

U.S. PATENT DOCUMENTS 4,572,500 A 2/1986 Weiss
4,577,860 A 3/1986 Matias et al.
4,582,320 A 4/1986 Shaw
4,588,232 A 5/1986 Kim et al.
4,589,656 A 5/1986 Baldwin
4,600,187 A 7/1986 Schenker
4,600,188 A 7/1986 Bangerter et al.
4,600,196 A 7/1986 Jones
4,602,781 A 7/1986 La Marsh et al.
4,605,220 A 8/1986 Troxel
4,607,841 A 8/1986 Gala
4,609,190 A 9/1986 Brentham
4,611,807 A 9/1986 Castillo
4,618,144 A 10/1986 Gibson
4,621,623 A 11/1986 Wang
4,625,962 A 12/1986 Street
4,627,619 A 12/1986 Rockwell et al.
4,630,817 A 12/1986 Buckley
4,632,385 A 12/1986 Geraci
4,632,386 A 12/1986 Beech
4,632,393 A 12/1986 Van Noord
4,634,121 A 1/1987 Sasaki
4,634,127 A 1/1987 Rockwell
4,637,605 A 1/1987 Ritchie
4,641,833 A 2/1987 Trethewey
4,642,769 A 2/1987 Petrofsky
4,645,197 A 2/1987 Mcfee
4,645,199 A 2/1987 Bloemendaal
4,645,200 A 2/1987 Hix
4,655,447 A 4/1987 Dubrinsky et al.
4,659,074 A 4/1987 Taitel et al.
4,659,077 A 4/1987 Stropkay
4,664,371 A 5/1987 Viander
4,664,373 A 5/1987 Hait
4,674,740 A 6/1987 Iams et al.
4,674,743 A 6/1987 Hirano
4,679,787 A 7/1987 Guilbault
4,684,126 A 8/1987 Dalebout et al.
4,685,669 A 8/1987 Decloux
4,685,670 A 8/1987 Zinkin
4,690,398 A 9/1987 Smith
4,690,406 A 9/1987 Hufenus
4,700,962 A 10/1987 Salmon
4,702,475 A 10/1987 Elstein et al.
4,705,028 A 11/1987 Melby
4,705,269 A 11/1987 DeBoer et al.
4,708,338 A 11/1987 Potts
4,709,917 A 12/1987 Yang
4,711,447 A 12/1987 Mansfield
4,712,790 A 12/1987 Szymski
4,720,093 A 1/1988 Del Mar
4,720,099 A 1/1988 Carlson
4,720,789 A 1/1988 Hector et al.
4,723,786 A 2/1988 Buchanan
4,726,582 A 2/1988 Fulks
4,729,562 A 3/1988 Pipasik
4,733,858 A 3/1988 Lan
4,733,860 A 3/1988 Steffee
4,736,944 A 4/1988 Johnson et al.
4,741,578 A 5/1988 Viellard
4,743,009 A 5/1988 Beale
4,746,112 A 5/1988 Fayal
4,746,115 A 5/1988 Lahman
4,750,735 A 6/1988 Furgerson et al.
4,750,736 A 6/1988 Watterson
4,762,317 A 8/1988 Camfield et al.
4,786,069 A 11/1988 Tang
4,796,881 A 1/1989 Watterson
4,809,976 A 3/1989 Berger
4,813,667 A 3/1989 Watterson
4,818,234 A 4/1989 Redington
4,819,935 A 4/1989 Dirksing
4,824,102 A 4/1989 Lo
4,824,104 A 4/1989 Bloch
4,824,132 A 4/1989 Moore
4,826,150 A 5/1989 Minoura
4,826,152 A 5/1989 Lo
4,828,257 A 5/1989 Dyer et al.
4,830,362 A 5/1989 Bull
4,830,363 A 5/1989 Kennedy
4,836,543 A 6/1989 Holzer
4,838,542 A 6/1989 Wilkinson
4,838,543 A 6/1989 Armstrong et al.
4,842,268 A 6/1989 Jenkins
4,844,450 A 7/1989 Rodgers, Jr.
4,844,456 A 7/1989 Habing et al.
4,850,585 A 7/1989 Dalebout
4,852,874 A 8/1989 Sleichter, III et al.
4,854,578 A 8/1989 Fulks
4,867,153 A 9/1989 Lorenzen et al.
4,867,443 A 9/1989 Jensen
4,869,494 A 9/1989 Lambert, Sr.
4,872,668 A 10/1989 McGillis et al.
4,880,225 A 11/1989 Lucas et al.
4,880,230 A 11/1989 Cook
4,887,967 A 12/1989 Letovsky et al.
4,898,379 A 2/1990 Shiba
4,900,013 A 2/1990 Rodgers, Jr.
4,900,017 A 2/1990 Bold, Jr.
4,907,798 A 3/1990 Burchatz
4,913,396 A 4/1990 Dalebout et al.
4,917,376 A 4/1990 Lo
4,917,377 A 4/1990 Chen
4,919,418 A 4/1990 Miller
4,921,242 A 5/1990 Watterson
4,923,193 A 5/1990 Pitzen et al.
4,925,183 A 5/1990 Kim
4,927,136 A 5/1990 Leask
4,929,022 A 5/1990 Geraci
4,932,651 A 6/1990 Defaux
4,938,474 A 7/1990 Sweeney et al.
4,938,475 A 7/1990 Sargeant
4,938,477 A 7/1990 Kuervers
4,940,233 A 7/1990 Bull
4,944,518 A 7/1990 Flynn
4,949,951 A 8/1990 Deola
4,949,954 A 8/1990 Hix
4,949,993 A 8/1990 Stark et al.
4,953,855 A 9/1990 Shields
4,958,832 A 9/1990 Kim
4,961,569 A 10/1990 Roberge
4,962,925 A 10/1990 Chang
4,968,028 A 11/1990 Wehrell
4,971,316 A 11/1990 Dalebout et al.
4,974,831 A 12/1990 Dunham
4,977,794 A 12/1990 Metcalf
4,981,199 A 1/1991 Tsai
4,981,294 A 1/1991 Dalebout et al.
4,984,801 A 1/1991 Deback
4,986,261 A 1/1991 Iams et al.
4,989,858 A 2/1991 Young et al.
5,000,440 A 3/1991 Lynch
5,000,443 A 3/1991 Dalebout et al.
5,000,444 A 3/1991 Dalebout et al.
5,002,271 A 3/1991 Gonzales
5,004,224 A 4/1991 Wang
5,004,229 A 4/1991 Lind
5,007,632 A 4/1991 Wilkinson
5,013,031 A 5/1991 Bull
5,016,870 A * 5/1991 Bulloch ..... A63B 22/0012 482/62
5,031,901 A 7/1991 Tunturipyora
5,035,418 A 7/1991 Harabayashi
RE33,662 E 8/1991 Blair et al.
5,037,090 A 8/1991 Fitzpatrick
5,039,088 A 8/1991 Shifferaw
5,040,786 A 8/1991 Jou
5,044,614 A 9/1991 Rau
5,048,824 A 9/1991 Chen
5,048,891 A 9/1991 Yach
5,050,877 A 9/1991 Wales
5,056,779 A 10/1991 Webb
5,058,882 A 10/1991 Dalebout et al.
5,058,888 A 10/1991 Walker et al.

(56) References Cited

U.S. PATENT DOCUMENTS 5,058,912 A 10/1991 Harroun
5,062,627 A 11/1991 Bingham
5,071,115 A 12/1991 Welch
5,072,929 A 12/1991 Peterson et al.
5,078,152 A 1/1992 Bond et al.
5,078,389 A 1/1992 Chen
5,081,991 A 1/1992 Chance
5,086,385 A 2/1992 Launey et al.
5,087,031 A 2/1992 Hoff
5,089,960 A 2/1992 Sweeney, Jr.
5,090,694 A 2/1992 Pauls et al.
5,094,449 A 3/1992 Stearns
5,104,119 A 4/1992 Lynch
5,104,120 A 4/1992 Watterson et al.
5,108,093 A 4/1992 Watterson
5,110,117 A 5/1992 Fisher et al.
5,113,427 A 5/1992 Ryoichi et al.
5,114,388 A 5/1992 Trulaske
5,114,391 A 5/1992 Pitzen et al.
5,129,450 A 7/1992 Hung
5,129,872 A 7/1992 Dalton et al.
5,129,873 A 7/1992 Henderson et al.
5,131,895 A 7/1992 Rogers, Jr.
5,135,216 A 8/1992 Bingham et al.
5,135,447 A 8/1992 Robards, Jr. et al.
5,137,501 A 8/1992 Mertesdorf
5,139,255 A 8/1992 Sollami
5,139,261 A 8/1992 Openiano
5,139,469 A 8/1992 Hennessey et al.
5,145,479 A 9/1992 Olschansky et al.
5,147,265 A 9/1992 Pauls et al.
5,149,312 A 9/1992 Croft et al.
5,156,650 A 10/1992 Bals
5,161,652 A 11/1992 Suzuki
5,162,029 A 11/1992 Schine
5,163,888 A 11/1992 Stearns
5,167,596 A 12/1992 Ferber
5,171,196 A 12/1992 Lynch
5,178,394 A 1/1993 Tanampai
5,178,589 A 1/1993 Wilson
5,178,593 A 1/1993 Roberts
5,178,599 A 1/1993 Scott
5,179,792 A 1/1993 Brantingham
5,180,347 A 1/1993 Chen
5,180,351 A 1/1993 Ehrenfried
5,180,353 A 1/1993 Snyderman
5,183,448 A 2/1993 Wang
5,183,449 A 2/1993 Decloux
5,188,577 A 2/1993 Young
5,190,505 A 3/1993 Dalebout et al.
5,195,664 A 3/1993 Rhea
5,195,935 A 3/1993 Fencel
5,195,937 A 3/1993 Engel et al.
5,199,931 A 4/1993 Easley et al.
5,201,333 A 4/1993 Shalmon et al.
5,201,772 A 4/1993 Maxwell
5,205,800 A 4/1993 Grant
5,209,481 A 5/1993 Deback
5,209,715 A 5/1993 Walker et al.
5,213,555 A 5/1993 Hood
5,217,422 A 6/1993 Domzalski
5,217,486 A 6/1993 Rice et al.
5,222,928 A 6/1993 Yacullo
5,224,909 A 7/1993 Hamilton
5,226,866 A 7/1993 Engel et al.
5,230,672 A 7/1993 Brown et al.
5,230,676 A 7/1993 Terauds
5,234,392 A 8/1993 Clark
5,236,407 A 8/1993 Wang
5,240,417 A 8/1993 Smithson et al.
5,244,444 A 9/1993 Wostry
5,250,013 A 10/1993 Brangi
5,254,059 A 10/1993 Arthur et al.
5,254,063 A 10/1993 House, Jr.
5,254,067 A 10/1993 Habing et al.
5,256,117 A 10/1993 Potts et al.
5,256,118 A 10/1993 Chen
5,261,864 A 11/1993 Fitzpatrick
5,261,867 A 11/1993 Chen
5,263,910 A 11/1993 Yang
5,263,914 A 11/1993 Simonson et al.
5,267,922 A 12/1993 Robinson
5,267,930 A 12/1993 Henes
5,277,677 A 1/1994 Terauds
5,277,678 A 1/1994 Friedebach et al.
5,277,681 A 1/1994 Holt
5,277,683 A 1/1994 Wilkins
5,279,529 A 1/1994 Eschenbach
5,279,531 A 1/1994 Ju
5,282,776 A 2/1994 Dalebout
5,284,458 A 2/1994 Perry et al.
5,284,460 A 2/1994 Miller et al.
5,290,204 A 3/1994 Lee
5,290,205 A 3/1994 Densmore et al.
5,290,211 A 3/1994 Stearns
5,290,212 A 3/1994 Metcalf
5,290,214 A 3/1994 Chen
5,292,293 A 3/1994 Schumacher
5,295,928 A 3/1994 Rennex
5,295,931 A 3/1994 Dreibelbis et al.
5,299,810 A 4/1994 Pierce et al.
5,299,994 A 4/1994 Chen
5,299,997 A 4/1994 Chen
5,302,161 A 4/1994 Loubert et al.
5,306,218 A 4/1994 Huang Chen
5,308,296 A 5/1994 Eckstein
5,316,534 A 5/1994 Dalebout et al.
5,318,490 A 6/1994 Henderson et al.
5,320,588 A 6/1994 Wanzer et al.
5,322,491 A 6/1994 Wanzer et al.
5,324,060 A 6/1994 Van Vooren et al.
5,324,242 A 6/1994 Lo
5,328,420 A 7/1994 Allen
5,328,421 A 7/1994 Stanalajczo
5,330,404 A 7/1994 Lopeteguy et al.
5,334,118 A 8/1994 Dantolan
5,336,141 A 8/1994 Vittone
5,336,142 A 8/1994 Dalebout et al.
5,338,277 A 8/1994 Yang
5,342,269 A 8/1994 Huang
RE34,728 E 9/1994 Hall-Tipping
5,346,445 A 9/1994 Chang
5,352,167 A 10/1994 Ulicny
5,352,169 A 10/1994 Eschenbach
5,354,248 A 10/1994 Rawls et al.
5,356,357 A 10/1994 Wang et al.
5,358,461 A 10/1994 Bailey, Jr.
5,362,069 A 11/1994 Hall-Tipping
5,366,428 A 11/1994 Liao
5,370,592 A 12/1994 Chang
5,370,594 A 12/1994 Grinblat
5,372,564 A 12/1994 Spirito
5,374,227 A 12/1994 Webb
5,382,209 A 1/1995 Pasier
5,383,715 A 1/1995 Homma et al.
5,383,829 A 1/1995 Miller
5,385,519 A 1/1995 Hsu
5,385,520 A 1/1995 Lepine et al.
5,387,164 A 2/1995 Brown, Jr.
5,391,130 A 2/1995 Green
5,399,133 A 3/1995 Haber et al.
5,401,226 A 3/1995 Stearns
5,403,252 A 4/1995 Leon et al.
5,403,254 A 4/1995 Lundin et al.
5,403,255 A 4/1995 Johnston
5,407,402 A 4/1995 Brown et al.
5,407,409 A 4/1995 Tang
5,409,435 A 4/1995 Daniels
5,410,471 A 4/1995 Alyfuku et al.
5,410,472 A 4/1995 Anderson
5,415,607 A 5/1995 Carpenter
5,417,643 A 5/1995 Taylor
5,419,619 A 5/1995 Lew
5,419,747 A 5/1995 Piaget

(56) References Cited

U.S. PATENT DOCUMENTS 5,419,751 A 5/1995 Byrd et al.
5,421,795 A 6/1995 Chen
5,423,728 A 6/1995 Goldberg
5,423,729 A 6/1995 Eschenbach
5,423,731 A 6/1995 Chen
5,429,568 A 7/1995 Chen
5,431,612 A 7/1995 Holden
5,433,687 A 7/1995 Hinzman et al.
5,435,798 A 7/1995 Habing et al.
5,435,799 A 7/1995 Lundin
5,435,801 A 7/1995 Hung
5,439,225 A 8/1995 Gvoich et al.
5,443,434 A 8/1995 Buchanan et al.
5,443,435 A 8/1995 Wilkinson
5,451,070 A 9/1995 Lindsay
5,453,065 A 9/1995 Lien et al.
5,453,066 A 9/1995 Richter, Jr.
5,454,550 A 10/1995 Christopherson
5,454,773 A 10/1995 Blanchard et al.
5,456,644 A 10/1995 Hecox et al.
5,458,553 A 10/1995 Wu
5,460,378 A 10/1995 Getts
5,464,378 A 11/1995 Lee
5,466,200 A 11/1995 Ulrich et al.
5,472,392 A 12/1995 Haan et al.
5,478,298 A 12/1995 Chen
5,484,151 A 1/1996 Tholkes
5,484,363 A 1/1996 Creelman
5,484,389 A 1/1996 Stark
5,486,150 A 1/1996 Randolph
5,489,249 A 2/1996 Brewer et al.
5,490,825 A 2/1996 Wilkinson
5,492,520 A 2/1996 Brown
5,496,235 A 3/1996 Stevens
5,499,956 A 3/1996 Habing et al.
5,499,958 A 3/1996 Hess
5,503,043 A 4/1996 Freudenberg
5,503,608 A 4/1996 Chang
5,505,678 A 4/1996 Johnston
5,507,709 A 4/1996 Wu
5,507,710 A 4/1996 Chen
5,509,879 A 4/1996 Lanzagorta
5,512,025 A 4/1996 Dalebout et al.
5,512,029 A 4/1996 Barnard
5,513,586 A 5/1996 Neely et al.
5,518,470 A 5/1996 Piaget et al.
5,518,473 A 5/1996 Miller
5,518,481 A 5/1996 Darkwah
5,520,599 A 5/1996 Chen
5,527,243 A 6/1996 Chen
5,527,245 A 6/1996 Dalebout et al.
5,527,246 A 6/1996 Rodgers, Jr.
5,527,249 A 6/1996 Harris
5,529,555 A 6/1996 Rodgers, Jr.
5,531,658 A 7/1996 L. S. C.
5,533,951 A 7/1996 Chang
5,536,225 A 7/1996 Neuberg et al.
5,538,299 A 7/1996 Nemeckay
5,540,637 A 7/1996 Rodgers, Jr.
5,542,503 A 8/1996 Dunn et al.
5,545,114 A 8/1996 Gvoich
5,549,526 A 8/1996 Rodgers, Jr.
5,554,089 A 9/1996 Jones
5,562,574 A 10/1996 Miller
5,562,577 A 10/1996 Nichols, Sr. et al.
5,573,480 A 11/1996 Rodgers, Jr.
5,575,745 A 11/1996 Lin
5,577,985 A 11/1996 Miller
5,580,249 A 12/1996 Jacobsen et al.
5,580,340 A 12/1996 Yu
5,584,700 A 12/1996 Feldman et al.
5,584,779 A 12/1996 Knecht
5,584,780 A 12/1996 Lin
5,584,781 A 12/1996 Chen
5,586,957 A 12/1996 Wilkinson
5,586,961 A 12/1996 Quint
5,591,104 A 1/1997 Andrus et al.
5,591,105 A 1/1997 Dalebout et al.
5,591,107 A 1/1997 Rodgers, Jr.
5,593,371 A 1/1997 Rodgers, Jr.
5,593,372 A 1/1997 Rodgers, Jr.
5,595,553 A 1/1997 Rodgers, Jr.
5,595,554 A 1/1997 Maresh
5,595,556 A 1/1997 Dalebout et al.
5,598,849 A 2/1997 Browne
5,599,261 A 2/1997 Easley et al.
5,600,310 A 2/1997 Whipple, III et al.
5,601,301 A 2/1997 Liu
5,603,281 A 2/1997 Harvey et al.
5,603,675 A 2/1997 Wu
5,605,149 A 2/1997 Warters
5,605,336 A 2/1997 Gaoiran
5,605,521 A 2/1997 Hsieh
5,611,756 A 3/1997 Miller
5,611,757 A 3/1997 Rodgers, Jr.
5,611,758 A 3/1997 Rodgers, Jr.
5,616,103 A 4/1997 Lee
5,619,412 A 4/1997 Hapka
5,619,991 A 4/1997 Sloane
5,620,400 A 4/1997 Foster
5,622,527 A 4/1997 Watterson et al.
5,624,353 A 4/1997 Naidus
5,626,401 A 5/1997 Terry, Sr. et al.
5,626,542 A 5/1997 Dalebout et al.
5,628,713 A 5/1997 Wilkinson
5,632,711 A 5/1997 Hwang
5,643,147 A 7/1997 Huang
5,643,162 A 7/1997 Landers et al.
5,651,754 A 7/1997 Chen
5,653,662 A 8/1997 Rodgers, Jr.
5,656,001 A 8/1997 Baatz
5,660,167 A 8/1997 Ryder
5,662,555 A 9/1997 Cloutier
5,662,556 A 9/1997 Gangloff
5,665,031 A 9/1997 Hsieh
5,665,032 A 9/1997 Chen
5,665,033 A 9/1997 Palmer
5,667,459 A 9/1997 Su
5,667,464 A 9/1997 Simonson
5,669,624 A 9/1997 Eichhorn
5,669,833 A 9/1997 Stone
5,669,865 A 9/1997 Gordon
5,672,140 A 9/1997 Watterson et al.
5,672,142 A 9/1997 Wu
5,674,161 A 10/1997 Lin
5,674,165 A 10/1997 Cohen et al.
5,679,100 A 10/1997 Charnitski
5,681,250 A 10/1997 Hoover et al.
5,685,804 A 11/1997 Whan-Tong et al.
5,690,582 A 11/1997 Ulrich et al.
5,690,589 A 11/1997 Rodgers, Jr.
5,692,994 A 12/1997 Eschenbach
5,695,434 A 12/1997 Dalebout et al.
5,695,435 A 12/1997 Dalebout et al.
5,702,334 A 12/1997 Lee
5,704,875 A 1/1998 Tanabe
5,707,320 A 1/1998 Yu
5,707,321 A 1/1998 Maresh
5,707,322 A 1/1998 Dreissigacker et al.
5,708,355 A 1/1998 Schrey
5,709,631 A 1/1998 Kleinsasser
5,709,632 A 1/1998 Socwell
5,709,633 A 1/1998 Sokol
5,711,749 A 1/1998 Miller
5,716,308 A 2/1998 Lee
5,718,660 A 2/1998 Chen
5,720,698 A 2/1998 Dalebout et al.
5,720,771 A 2/1998 Snell
5,722,418 A 3/1998 Bro
5,722,917 A 3/1998 Olschansky et al.
5,722,918 A 3/1998 Lee
5,722,921 A 3/1998 Simonson
5,722,922 A 3/1998 Watterson et al.
5,725,457 A 3/1998 Maresh

(56) References Cited

U.S. PATENT DOCUMENTS

| | | | |
|---|---|---|---|
| 5,733,227 | A | 3/1998 | Lee |
| 5,733,229 | A | 3/1998 | Dalebout et al. |
| 5,733,233 | A | 3/1998 | Webber |
| 5,735,773 | A | 4/1998 | Vittone |
| 5,735,774 | A | 4/1998 | Maresh |
| 5,738,611 | A | 4/1998 | Ehrenfried |
| 5,738,612 | A | 4/1998 | Tsuda |
| 5,738,614 | A | 4/1998 | Rodgers, Jr. |
| 5,741,205 | A | 4/1998 | Doll et al. |
| 5,743,830 | A | 4/1998 | Ho |
| 5,743,832 | A | 4/1998 | Sands et al. |
| 5,743,833 | A | 4/1998 | Watterson et al. |
| 5,743,834 | A | 4/1998 | Rodgers, Jr. |
| 5,746,681 | A | 5/1998 | Bull |
| 5,746,683 | A | 5/1998 | Lee |
| 5,746,688 | A | 5/1998 | Prager |
| 5,749,807 | A | 5/1998 | Webb |
| 5,749,809 | A | 5/1998 | Lin |
| 5,752,897 | A | 5/1998 | Skowronski et al. |
| 5,755,642 | A | 5/1998 | Miller |
| 5,755,643 | A | 5/1998 | Sands |
| 5,755,651 | A | 5/1998 | Homyonfer |
| 5,759,136 | A | 6/1998 | Chen |
| 5,762,587 | A | 6/1998 | Dalebout et al. |
| 5,762,588 | A | 6/1998 | Chen |
| 5,766,113 | A | 6/1998 | Rodgers, Jr. |
| 5,769,757 | A | 6/1998 | Fulks |
| 5,769,760 | A | 6/1998 | Lin |
| 5,769,766 | A | 6/1998 | Huang |
| 5,772,522 | A | 6/1998 | Nesbit |
| 5,776,006 | A | 7/1998 | Gruber |
| 5,779,598 | A | 7/1998 | Lee |
| 5,779,599 | A | 7/1998 | Chen |
| 5,779,607 | A | 7/1998 | Harris |
| 5,782,639 | A | 7/1998 | Beal |
| 5,782,722 | A | 7/1998 | Sands |
| 5,785,630 | A | 7/1998 | Bobick et al. |
| 5,788,608 | A | 8/1998 | Wilkinson |
| 5,788,609 | A | 8/1998 | Miller |
| 5,788,610 | A | 8/1998 | Eschenbach |
| 5,788,617 | A | 8/1998 | Paris |
| 5,792,026 | A | 8/1998 | Maresh |
| 5,792,027 | A | 8/1998 | Gvoich |
| 5,792,028 | A | 8/1998 | Jarvie |
| 5,792,029 | A | 8/1998 | Gordon |
| 5,795,268 | A | 8/1998 | Husted |
| 5,800,323 | A | 9/1998 | Ansel |
| 5,803,871 | A | 9/1998 | Stearns et al. |
| 5,810,696 | A | 9/1998 | Webb |
| 5,813,949 | A | 9/1998 | Rodgers, Jr. |
| 5,823,917 | A | 10/1998 | Chen |
| 5,826,575 | A | 10/1998 | Lall |
| 5,826,898 | A | 10/1998 | Fortier et al. |
| 5,827,158 | A | 10/1998 | Drecksel |
| 5,830,107 | A | 11/1998 | Brigliadoro |
| 5,830,113 | A | 11/1998 | Coody et al. |
| 5,830,114 | A | 11/1998 | Halfen et al. |
| 5,833,582 | A | 11/1998 | Chen |
| 5,833,583 | A | 11/1998 | Chuang |
| 5,833,584 | A | 11/1998 | Piaget et al. |
| 5,836,854 | A | 11/1998 | Kuo |
| 5,836,855 | A | 11/1998 | Eschenbach |
| 5,836,856 | A | 11/1998 | Mattoo |
| 5,836,858 | A | 11/1998 | Sharff |
| 5,839,990 | A | 11/1998 | Virkkala |
| 5,846,166 | A | 12/1998 | Kuo |
| 5,848,954 | A | 12/1998 | Stearns et al. |
| 5,855,538 | A | 1/1999 | Argabright |
| 5,857,939 | A | 1/1999 | Kaufman |
| 5,857,941 | A | 1/1999 | Maresh |
| 5,860,893 | A | 1/1999 | Watterson et al. |
| 5,860,895 | A | 1/1999 | Lee |
| 5,862,892 | A | 1/1999 | Conley |
| 5,865,711 | A | 2/1999 | Chen |
| 5,865,714 | A | 2/1999 | Marlowe |
| 5,865,733 | A | 2/1999 | Malinouskas et al. |
| 5,868,108 | A | 2/1999 | Schmitz et al. |
| 5,868,333 | A | 2/1999 | Nayak |
| 5,871,421 | A | 2/1999 | Trulaske et al. |
| 5,871,425 | A | 2/1999 | Gvoich |
| 5,873,369 | A | 2/1999 | Laniado et al. |
| 5,873,608 | A | 2/1999 | Tharp |
| 5,876,307 | A | 3/1999 | Stearns |
| 5,876,308 | A | 3/1999 | Jarvie |
| 5,878,479 | A | 3/1999 | Dickerson et al. |
| 5,879,271 | A | 3/1999 | Stearns et al. |
| 5,880,677 | A | 3/1999 | Lestician |
| 5,884,735 | A | 3/1999 | Eckel et al. |
| 5,888,172 | A | 3/1999 | Andrus et al. |
| 5,890,906 | A | 4/1999 | Macri |
| 5,890,995 | A | 4/1999 | Bobick et al. |
| 5,890,997 | A | 4/1999 | Roth |
| 5,891,003 | A | 4/1999 | Deac et al. |
| 5,893,820 | A | 4/1999 | Maresh et al. |
| 5,895,339 | A | 4/1999 | Maresh |
| 5,897,460 | A | 4/1999 | McBride et al. |
| 5,899,834 | A | 5/1999 | Dalebout et al. |
| 5,904,636 | A | 5/1999 | Chen |
| 5,904,637 | A | 5/1999 | Kuo |
| 5,904,641 | A | 5/1999 | Huang |
| 5,910,072 | A | 6/1999 | Rawls et al. |
| 5,911,649 | A | 6/1999 | Miller |
| 5,913,751 | A | 6/1999 | Eschenbach |
| 5,913,752 | A | 6/1999 | Bolf |
| 5,916,063 | A | 6/1999 | Alessandri |
| 5,916,065 | A | 6/1999 | McBride et al. |
| 5,916,069 | A | 6/1999 | Wang |
| 5,917,692 | A | 6/1999 | Schmitz et al. |
| 5,919,118 | A | 7/1999 | Stearns |
| 5,919,174 | A | 7/1999 | Hanson |
| 5,921,894 | A | 7/1999 | Eschenbach |
| 5,921,896 | A | 7/1999 | Boland |
| 5,924,962 | A | 7/1999 | Rodgers, Jr. |
| 5,924,963 | A | 7/1999 | Maresh |
| 5,938,551 | A | 8/1999 | Warner |
| 5,938,568 | A | 8/1999 | Maresh |
| 5,938,571 | A | 8/1999 | Stevens |
| 5,944,638 | A | 8/1999 | Maresh |
| 5,947,824 | A | 9/1999 | Minami et al. |
| 5,947,869 | A | 9/1999 | Shea |
| 5,947,872 | A | 9/1999 | Ryan et al. |
| 5,951,449 | A | 9/1999 | Oppriecht |
| 5,957,814 | A | 9/1999 | Eschenbach |
| 5,961,423 | A | 10/1999 | Sellers |
| 5,961,430 | A | 10/1999 | Zuckerman et al. |
| 5,964,684 | A | 10/1999 | Sokol |
| 5,967,944 | A | 10/1999 | Vittone et al. |
| 5,971,902 | A | 10/1999 | Robertson et al. |
| 5,984,839 | A | 11/1999 | Corkum |
| 5,989,159 | A | 11/1999 | Chen |
| 5,989,161 | A | 11/1999 | Wang et al. |
| 5,989,163 | A | 11/1999 | Rodgers, Jr. |
| 5,991,143 | A | 11/1999 | Wright et al. |
| 5,993,358 | A | 11/1999 | Gureghian et al. |
| 5,993,359 | A | 11/1999 | Eschenbach |
| 5,997,445 | A | 12/1999 | Maresh |
| 5,997,446 | A | 12/1999 | Stearns |
| 6,001,046 | A | 12/1999 | Chang |
| 6,003,481 | A | 12/1999 | Pischinger et al. |
| 6,004,244 | A | 12/1999 | Simonson |
| 6,007,462 | A | 12/1999 | Chen |
| 6,010,451 | A | 1/2000 | Clawson |
| 6,013,007 | A | 1/2000 | Root et al. |
| 6,013,011 | A | 1/2000 | Moore et al. |
| 6,014,432 | A | 1/2000 | Modney |
| 6,014,913 | A | 1/2000 | Masahiro |
| 6,017,294 | A | 1/2000 | Eschenbach |
| 6,017,295 | A | 1/2000 | Eschenbach |
| 6,019,710 | A | 2/2000 | Dalebout et al. |
| 6,022,296 | A | 2/2000 | Yu |
| 6,024,676 | A | 2/2000 | Eschenbach |
| 6,027,430 | A | 2/2000 | Stearns et al. |
| 6,027,431 | A | 2/2000 | Stearns |
| 6,030,319 | A | 2/2000 | Wu |

(56) References Cited

U.S. PATENT DOCUMENTS

| | | | |
|---|---|---|---|
| 6,030,320 | A | 2/2000 | Stearns |
| 6,033,344 | A | 3/2000 | Trulaske et al. |
| 6,036,622 | A | 3/2000 | Gordon |
| 6,039,676 | A | 3/2000 | Clive |
| 6,042,510 | A | 3/2000 | Miller |
| 6,042,512 | A | 3/2000 | Eschenbach |
| 6,042,519 | A | 3/2000 | Shea |
| 6,045,487 | A | 4/2000 | Miller |
| 6,045,488 | A | 4/2000 | Eschenbach |
| 6,050,822 | A | 4/2000 | Faughn |
| 6,050,920 | A | 4/2000 | Ehrenfried |
| 6,050,924 | A | 4/2000 | Shea |
| 6,050,942 | A | 4/2000 | Rust et al. |
| 6,053,737 | A | 4/2000 | Babbitt et al. |
| 6,053,844 | A | 4/2000 | Clem |
| 6,053,847 | A | 4/2000 | Stearns et al. |
| 6,053,848 | A | 4/2000 | Eschenbach |
| 6,056,678 | A | 5/2000 | Giannelli et al. |
| 6,063,008 | A | 5/2000 | McBride |
| 6,063,009 | A | 5/2000 | Stearns |
| 6,063,013 | A | 5/2000 | Vathappallil |
| 6,071,215 | A | 6/2000 | Raffo |
| 6,074,328 | A | 6/2000 | Johnson |
| 6,075,525 | A | 6/2000 | Hsieh |
| 6,077,196 | A | 6/2000 | Eschenbach |
| 6,077,198 | A | 6/2000 | Eschenbach |
| 6,077,202 | A | 6/2000 | Gray |
| 6,090,013 | A | 7/2000 | Eschenbach |
| 6,090,014 | A | 7/2000 | Eschenbach |
| 6,092,822 | A | 7/2000 | Salmon |
| 6,099,439 | A | 8/2000 | Ryan et al. |
| 6,102,832 | A | 8/2000 | Tani |
| 6,106,439 | A | 8/2000 | Boland |
| 6,106,441 | A | 8/2000 | Chen |
| 6,110,076 | A | 8/2000 | Hurt |
| 6,113,518 | A | 9/2000 | Maresh |
| 6,117,055 | A | 9/2000 | Boland |
| 6,120,385 | A | 9/2000 | Nemeckay |
| 6,120,421 | A | 9/2000 | Kuo |
| 6,123,649 | A | 9/2000 | Lee |
| 6,123,650 | A | 9/2000 | Birrell |
| 6,126,573 | A | 10/2000 | Eschenbach |
| 6,126,574 | A | 10/2000 | Stearns et al. |
| 6,135,923 | A | 10/2000 | Stearns |
| 6,135,926 | A | 10/2000 | Lee |
| 6,135,927 | A | 10/2000 | Lo |
| 6,142,870 | A | 11/2000 | Wada et al. |
| 6,142,913 | A | 11/2000 | Ewert |
| 6,146,313 | A | 11/2000 | Whan-Tong et al. |
| 6,146,314 | A | 11/2000 | Lee |
| 6,149,551 | A | 11/2000 | Pyles et al. |
| 6,149,552 | A | 11/2000 | Chen |
| 6,152,856 | A | 11/2000 | Studor et al. |
| 6,152,859 | A | 11/2000 | Stearns |
| 6,152,866 | A | 11/2000 | Kuo |
| 6,162,153 | A | 12/2000 | Perez, Jr. |
| 6,164,423 | A | 12/2000 | Dickerson |
| 6,165,107 | A | 12/2000 | Birrell |
| 6,168,552 | B1 | 1/2001 | Eschenbach |
| 6,171,186 | B1 | 1/2001 | Kurosawa et al. |
| 6,171,216 | B1 | 1/2001 | Wang |
| 6,171,217 | B1 | 1/2001 | Cutler |
| 6,176,814 | B1 | 1/2001 | Ryan et al. |
| 6,182,531 | B1 | 2/2001 | Gallagher et al. |
| 6,183,397 | B1 | 2/2001 | Stearns et al. |
| 6,183,398 | B1 | 2/2001 | Rufino et al. |
| 6,186,290 | B1 | 2/2001 | Carlson |
| 6,186,926 | B1 | 2/2001 | Ellis |
| 6,190,289 | B1 | 2/2001 | Pyles et al. |
| 6,193,631 | B1 | 2/2001 | Hickman |
| 6,196,948 | B1 | 3/2001 | Stearns |
| 6,196,954 | B1 | 3/2001 | Chen |
| 6,206,804 | B1 | 3/2001 | Maresh |
| 6,206,806 | B1 | 3/2001 | Chu |
| 6,210,305 | B1 | 4/2001 | Eschenbach |
| 6,211,451 | B1 | 4/2001 | Tohgi et al. |
| 6,213,962 | B1 | 4/2001 | Shimizu |
| 6,217,483 | B1 | 4/2001 | Kallassy |
| 6,217,486 | B1 | 4/2001 | Rosenow |
| 6,220,990 | B1 | 4/2001 | Crivello |
| 6,220,991 | B1 | 4/2001 | Sellers |
| 6,224,080 | B1 | 5/2001 | Ross |
| 6,227,200 | B1 | 5/2001 | Crump et al. |
| 6,230,047 | B1 | 5/2001 | McHugh |
| 6,234,935 | B1 | 5/2001 | Chu |
| 6,234,938 | B1 | 5/2001 | Chen |
| 6,238,321 | B1 | 5/2001 | Arnold et al. |
| 6,244,988 | B1 | 6/2001 | Delman |
| 6,244,992 | B1 | 6/2001 | James |
| 6,248,044 | B1 | 6/2001 | Stearns et al. |
| 6,248,045 | B1 | 6/2001 | Stearns et al. |
| 6,251,047 | B1 | 6/2001 | Stearns et al. |
| 6,251,048 | B1 | 6/2001 | Kaufman |
| 6,254,514 | B1 | 7/2001 | Maresh et al. |
| 6,254,516 | B1 | 7/2001 | Giannelli et al. |
| 6,261,209 | B1 | 7/2001 | Coody |
| 6,264,588 | B1 | 7/2001 | Ellis |
| 6,273,843 | B1 | 8/2001 | Lo |
| 6,277,055 | B1 | 8/2001 | Birrell et al. |
| 6,280,361 | B1 | 8/2001 | Harvey et al. |
| 6,280,362 | B1 | 8/2001 | Dalebout et al. |
| 6,287,239 | B1 | 9/2001 | Hernandez |
| 6,302,830 | B1 | 10/2001 | Stearns |
| 6,302,833 | B1 | 10/2001 | Ellis et al. |
| 6,311,999 | B1 | 11/2001 | Kueschall |
| 6,312,363 | B1 | 11/2001 | Watterson et al. |
| 6,315,702 | B1 | 11/2001 | Ikonomopoulos |
| 6,328,325 | B1 | 12/2001 | Greenwood |
| 6,338,698 | B1 | 1/2002 | Stearns et al. |
| 6,340,340 | B1 | 1/2002 | Stearns |
| 6,356,856 | B1 | 3/2002 | Damen et al. |
| 6,358,187 | B1 | 3/2002 | Smith |
| 6,361,477 | B1 | 3/2002 | Kolda |
| 6,368,252 | B1 | 4/2002 | Stearns |
| 6,368,254 | B1 | 4/2002 | Wall |
| 6,371,850 | B1 | 4/2002 | Sonoda |
| 6,371,895 | B1 | 4/2002 | Endelman et al. |
| 6,375,580 | B1 | 4/2002 | Schmidt |
| 6,379,289 | B1 | 4/2002 | Gossie |
| 6,387,015 | B1 | 5/2002 | Watson |
| 6,390,953 | B1 | 5/2002 | Maresh |
| 6,397,797 | B1 | 6/2002 | Kolmanovsky et al. |
| 6,398,695 | B2 | 6/2002 | Miller |
| 6,409,632 | B1 | 6/2002 | Eschenbach |
| 6,416,442 | B1 | 7/2002 | Stearns et al. |
| 6,419,611 | B1 | 7/2002 | Levine et al. |
| 6,422,957 | B1 | 7/2002 | Winter et al. |
| 6,422,977 | B1 | 7/2002 | Eschenbach |
| 6,428,449 | B1 | 8/2002 | Apseloff |
| 6,432,004 | B1 | 8/2002 | Nemeckay |
| 6,436,007 | B1 | 8/2002 | Eschenbach |
| 6,440,042 | B2 | 8/2002 | Eschenbach |
| 6,447,424 | B1 | 9/2002 | Ashby et al. |
| 6,450,922 | B1 | 9/2002 | Henderson et al. |
| 6,450,923 | B1 | 9/2002 | Vatti |
| 6,450,925 | B1 | 9/2002 | Kuo |
| 6,454,679 | B1 | 9/2002 | Radow |
| 6,454,682 | B1 | 9/2002 | Kuo |
| 6,458,060 | B1 | 10/2002 | Watterson et al. |
| 6,461,279 | B1 | 10/2002 | Kuo |
| 6,468,184 | B1 | 10/2002 | Lee |
| 6,468,188 | B1 | 10/2002 | Koenig |
| 6,471,622 | B1 | 10/2002 | Hammer et al. |
| 6,482,130 | B1 | 11/2002 | Pasero et al. |
| 6,482,139 | B1 | 11/2002 | Haag |
| 6,485,041 | B1 | 11/2002 | Janssen |
| 6,485,395 | B1 | 11/2002 | Stearns |
| 6,488,612 | B2 | 12/2002 | Sechrest et al. |
| 6,491,609 | B2 | 12/2002 | Webber |
| 6,494,817 | B2 | 12/2002 | Lake |
| 6,497,426 | B2 | 12/2002 | Vanpelt |
| 6,500,096 | B1 | 12/2002 | Farney |
| 6,500,099 | B1 | 12/2002 | Eschenbach |
| 6,500,106 | B1 | 12/2002 | Fulks |

(56) References Cited

U.S. PATENT DOCUMENTS

| | | | |
|---|---|---|---|
| 6,503,173 | B2 | 1/2003 | Clem |
| 6,505,503 | B1 | 1/2003 | Teresi et al. |
| 6,505,845 | B1 | 1/2003 | Fong |
| 6,506,142 | B2 | 1/2003 | Itoh et al. |
| 6,511,402 | B2 | 1/2003 | Shu et al. |
| 6,513,532 | B2 | 2/2003 | Mault et al. |
| 6,514,180 | B1 | 2/2003 | Rawls |
| 6,520,891 | B1 | 2/2003 | Stephens, Jr. |
| 6,527,674 | B1 | 3/2003 | Chem |
| 6,527,677 | B2 | 3/2003 | Maresh |
| 6,527,685 | B2 | 3/2003 | Endelman et al. |
| 6,530,864 | B1 | 3/2003 | Parks |
| 6,540,646 | B2 | 4/2003 | Stearns |
| 6,544,146 | B1 | 4/2003 | Stearns et al. |
| 6,544,147 | B1 | 4/2003 | Wang |
| 6,544,154 | B2 | 4/2003 | Forcillo |
| 6,547,701 | B1 | 4/2003 | Eschenbach |
| 6,547,702 | B1 | 4/2003 | Heidecke |
| 6,551,217 | B2 | 4/2003 | Kaganovsky |
| 6,551,218 | B2 | 4/2003 | Goh |
| 6,554,750 | B2 | 4/2003 | Stearns et al. |
| 6,563,489 | B1 | 5/2003 | Latypov et al. |
| 6,565,486 | B2 | 5/2003 | Stearns |
| 6,569,061 | B2 | 5/2003 | Stearns et al. |
| 6,572,511 | B1 | 6/2003 | Volpe |
| 6,572,512 | B2 | 6/2003 | Anderson et al. |
| 6,575,877 | B2 | 6/2003 | Rufino et al. |
| 6,575,884 | B1 | 6/2003 | Eazor |
| 6,579,210 | B1 | 6/2003 | Stearns et al. |
| 6,582,342 | B2 | 6/2003 | Kaufman |
| 6,582,343 | B2 | 6/2003 | Lin |
| 6,582,344 | B2 | 6/2003 | Tang |
| 6,585,647 | B1 | 7/2003 | Winder |
| 6,589,139 | B1 | 7/2003 | Butterworth |
| 6,592,136 | B2 | 7/2003 | Becker et al. |
| 6,592,502 | B1 | 7/2003 | Phillips |
| 6,595,905 | B2 | 7/2003 | McBride |
| 6,599,201 | B1 | 7/2003 | Grant |
| 6,604,008 | B2 | 8/2003 | Chudley et al. |
| 6,605,020 | B1 | 8/2003 | Huang |
| 6,605,024 | B2 | 8/2003 | Stearns |
| 6,606,994 | B1 | 8/2003 | Clark |
| 6,612,936 | B1 | 9/2003 | Matias |
| 6,620,079 | B2 | 9/2003 | Kuo |
| 6,620,080 | B1 | 9/2003 | Gray |
| 6,626,802 | B1 | 9/2003 | Rodgers, Jr. |
| 6,645,125 | B1 | 11/2003 | Stearns et al. |
| 6,647,826 | B2 | 11/2003 | Okajima et al. |
| 6,648,353 | B1 | 11/2003 | Cabal |
| 6,648,798 | B2 | 11/2003 | Yoo |
| 6,648,801 | B2 | 11/2003 | Stearns et al. |
| 6,652,426 | B2 | 11/2003 | Carter |
| 6,659,916 | B1 | 12/2003 | Shea |
| 6,659,918 | B2 | 12/2003 | Schiessl |
| 6,669,609 | B2 | 12/2003 | Gerschefske et al. |
| 6,672,991 | B2 | 1/2004 | O'Malley |
| 6,672,992 | B1 | 1/2004 | Lo et al. |
| 6,672,994 | B1 | 1/2004 | Stearns et al. |
| 6,675,041 | B2 | 1/2004 | Dickinson |
| 6,676,569 | B1 | 1/2004 | Radow |
| 6,679,813 | B1 | 1/2004 | Gray |
| 6,681,728 | B2 | 1/2004 | Haghgooie |
| 6,682,462 | B1 | 1/2004 | Lee |
| 6,685,607 | B1 | 2/2004 | Olson |
| 6,687,535 | B2 | 2/2004 | Hautala et al. |
| 6,688,624 | B2 | 2/2004 | Christensen et al. |
| 6,689,020 | B2 | 2/2004 | Stearns |
| 6,689,057 | B1 | 2/2004 | Shinsel et al. |
| 6,692,412 | B2 | 2/2004 | Chen et al. |
| 6,692,414 | B1 | 2/2004 | Gelbart |
| 6,692,416 | B1 | 2/2004 | Davis |
| 6,692,417 | B2 | 2/2004 | Burrell |
| 6,695,694 | B2 | 2/2004 | Ishikawa et al. |
| 6,695,749 | B2 | 2/2004 | Kuo |
| 6,695,751 | B1 | 2/2004 | Hsu |
| 6,702,719 | B1 | 3/2004 | Brown et al. |
| 6,702,723 | B2 | 3/2004 | Landfair |
| 6,709,368 | B1 | 3/2004 | Chue |
| 6,712,737 | B1 | 3/2004 | Nusbaum |
| 6,715,779 | B2 | 4/2004 | Eschenbach |
| 6,716,144 | B1 | 4/2004 | Shifferaw |
| 6,719,665 | B1 | 4/2004 | Lai |
| 6,726,600 | B2 | 4/2004 | Miller |
| 6,726,606 | B2 | 4/2004 | Jacobsen |
| 6,729,342 | B2 | 5/2004 | Serhan |
| 6,730,002 | B2 | 5/2004 | Hald et al. |
| 6,739,989 | B2 | 5/2004 | Liberatore |
| 6,743,153 | B2 | 6/2004 | Watterson et al. |
| 6,743,155 | B2 | 6/2004 | Pan |
| 6,743,158 | B2 | 6/2004 | Giannelli et al. |
| 6,749,540 | B1 | 6/2004 | Pasero et al. |
| 6,749,546 | B2 | 6/2004 | Yang |
| 6,752,744 | B2 | 6/2004 | Arnold et al. |
| 6,758,790 | B1 | 7/2004 | Ellis |
| 6,758,792 | B1 | 7/2004 | Chang |
| 6,761,665 | B2 | 7/2004 | Nguyen |
| 6,761,667 | B1 | 7/2004 | Cutler et al. |
| 6,764,088 | B2 | 7/2004 | Hung |
| 6,764,431 | B2 | 7/2004 | Yoss |
| 6,770,015 | B2 | 8/2004 | Simonson |
| 6,773,022 | B2 | 8/2004 | Janssen |
| 6,781,314 | B2 | 8/2004 | Shon et al. |
| 6,783,481 | B2 | 8/2004 | Stearns |
| 6,783,482 | B2 | 8/2004 | Oglesby et al. |
| 6,786,669 | B2 | 9/2004 | Tsui et al. |
| 6,786,821 | B2 | 9/2004 | Nobe et al. |
| 6,786,848 | B2 | 9/2004 | Yamashita et al. |
| 6,790,162 | B1 | 9/2004 | Ellis et al. |
| 6,793,609 | B1 | 9/2004 | Fan |
| 6,796,927 | B2 | 9/2004 | Toyama |
| 6,796,928 | B1 | 9/2004 | Christopher |
| 6,811,517 | B1 | 11/2004 | Eschenbach |
| 6,817,968 | B2 | 11/2004 | Galbraith et al. |
| 6,821,232 | B1 | 11/2004 | Wang |
| 6,824,502 | B1 | 11/2004 | Huang |
| 6,830,538 | B2 | 12/2004 | Eschenbach |
| 6,830,542 | B2 | 12/2004 | Ball |
| 6,835,166 | B1 | 12/2004 | Stearns et al. |
| 6,837,503 | B2 | 1/2005 | Chen et al. |
| 6,837,829 | B2 | 1/2005 | Eschenbach |
| 6,840,892 | B1 | 1/2005 | Wu |
| 6,846,272 | B2 | 1/2005 | Rosenow et al. |
| 6,849,034 | B2 | 2/2005 | Eschenbach |
| 6,855,093 | B2 | 2/2005 | Anderson et al. |
| 6,860,836 | B1 | 3/2005 | Wu |
| 6,863,641 | B1 | 3/2005 | Brown et al. |
| 6,865,969 | B2 | 3/2005 | Stevens |
| 6,875,160 | B2 | 4/2005 | Watterson et al. |
| 6,878,102 | B1 | 4/2005 | Commisso |
| 6,881,176 | B2 | 4/2005 | Oishi et al. |
| 6,884,227 | B2 | 4/2005 | Talish |
| 6,887,190 | B1 | 5/2005 | Azari |
| 6,895,834 | B1 | 5/2005 | Baatz |
| 6,902,513 | B1 | 6/2005 | Mcclure |
| 6,902,515 | B2 | 6/2005 | Howell et al. |
| 6,908,416 | B2 | 6/2005 | Mercado et al. |
| 6,908,417 | B2 | 6/2005 | Jackson |
| 6,910,991 | B2 | 6/2005 | Matsumoto |
| 6,910,992 | B2 | 6/2005 | Arguilez |
| 6,916,278 | B2 | 7/2005 | Webber |
| 6,918,859 | B1 | 7/2005 | Yeh |
| 6,918,860 | B1 | 7/2005 | Nusbaum |
| 6,921,355 | B2 | 7/2005 | Campanaro et al. |
| 6,923,749 | B1 | 8/2005 | Smith |
| 6,926,645 | B1 | 8/2005 | Stearns |
| 6,926,646 | B1 | 8/2005 | Nguyen |
| 6,926,647 | B1 | 8/2005 | Johnson |
| 6,932,308 | B2 | 8/2005 | Talish |
| 6,939,271 | B1 | 9/2005 | Whan-Tong et al. |
| 6,945,912 | B2 | 9/2005 | Levi |
| 6,945,917 | B1 | 9/2005 | Baatz |
| 6,949,036 | B2 | 9/2005 | Ciesar et al. |
| 6,949,053 | B1 | 9/2005 | Stearns |
| 6,949,054 | B1 | 9/2005 | Stearns |

(56) References Cited

U.S. PATENT DOCUMENTS 6,954,261 B2 10/2005 McClurg
6,955,610 B1 10/2005 Czaja et al.
6,966,082 B2 11/2005 Bloemer et al.
6,966,872 B2 11/2005 Eschenbach
6,971,976 B2 12/2005 Endelman et al.
6,979,283 B2 12/2005 Pan
6,981,932 B1 1/2006 Huang et al.
6,991,586 B2 1/2006 Lapcevic
6,994,656 B2 2/2006 Liao et al.
6,994,657 B1 2/2006 Eschenbach
6,997,852 B2 2/2006 Watterson et al.
7,003,122 B2 2/2006 Chen
7,004,888 B1 2/2006 Weng
7,008,173 B2 3/2006 Gabrys et al.
7,009,613 B2 3/2006 Goden
7,011,607 B2 3/2006 Kolda et al.
7,022,047 B2 4/2006 Cohen et al.
7,022,048 B1 4/2006 Fernandez
7,022,049 B2 4/2006 Ryan et al.
7,025,710 B2 4/2006 Corbalis et al.
7,025,711 B2 4/2006 Eschenbach
7,033,176 B2 4/2006 Feldman
7,033,269 B2 4/2006 Namba et al.
7,033,305 B1 4/2006 Stearns
7,033,306 B2 4/2006 Graber
7,037,241 B2 5/2006 Kuo
7,041,034 B1 5/2006 Stearns et al.
7,044,891 B1 5/2006 Rivera
7,048,640 B2 5/2006 Light
7,052,438 B2 5/2006 Eschenbach
7,052,440 B2 5/2006 Pyles et al.
7,052,444 B2 5/2006 Webber
7,052,446 B2 5/2006 Morris et al.
7,056,224 B1 6/2006 Keyes
7,056,265 B1 6/2006 Shea
7,060,005 B2 6/2006 Carlsen et al.
7,060,006 B1 6/2006 Watterson et al.
7,077,420 B1 7/2006 Santoski
7,083,546 B2 8/2006 Zillig
7,083,549 B1 8/2006 Fan
7,086,993 B1 8/2006 Maresh
7,086,999 B2 8/2006 Jeneve et al.
7,087,001 B1 8/2006 Ihli
7,090,622 B2 8/2006 Hetrick
7,090,623 B2 8/2006 Stewart et al.
7,094,185 B2 8/2006 Greenland
7,097,591 B2 8/2006 Moon
7,097,592 B2 8/2006 Wang
7,097,593 B2 8/2006 Chang
7,097,598 B2 8/2006 Lee
7,097,600 B2 8/2006 Gray
7,101,330 B2 9/2006 Elbaz et al.
7,104,929 B1 9/2006 Eschenbach
7,104,937 B2 9/2006 Arbuckle
7,108,644 B2 9/2006 Clark, III
7,108,663 B2 9/2006 Talish
7,112,161 B2 * 9/2006 Maresh ..... A63B 21/068 482/52
7,115,073 B2 10/2006 Nizamuddin
7,137,934 B2 11/2006 Parmater
7,137,938 B2 11/2006 Gottlieb
7,140,626 B1 11/2006 Keay
7,141,008 B2 11/2006 Krull et al.
7,153,238 B2 12/2006 Anderson et al.
7,156,776 B2 1/2007 Maser
7,163,490 B2 1/2007 Chen
7,163,491 B2 1/2007 Rufino
7,166,062 B1 1/2007 Watterson et al.
7,166,064 B2 1/2007 Watterson et al.
7,166,067 B2 1/2007 Talish et al.
7,169,087 B2 1/2007 Ercanbrack et al.
7,169,088 B2 1/2007 Rodgers, Jr.
7,169,089 B2 1/2007 Rodgers, Jr.
7,169,090 B1 1/2007 Maresh
7,172,531 B2 2/2007 Rodgers, Jr.
7,179,205 B2 2/2007 Schmidt
7,179,207 B2 2/2007 Gerschefske
7,182,714 B2 2/2007 Moon
7,186,270 B2 3/2007 Elkins
7,191,383 B2 3/2007 Lin et al.
7,192,388 B2 3/2007 Dalebout et al.
7,198,590 B1 4/2007 Nicholas
7,201,705 B2 4/2007 Rodgers, Jr.
7,201,706 B1 4/2007 Lee
7,201,707 B1 4/2007 Moon
7,204,041 B1 4/2007 Bailey, Sr. et al.
7,207,925 B2 4/2007 Laturell et al.
7,211,029 B2 5/2007 Kau
7,214,167 B2 5/2007 Stearns
7,214,168 B2 5/2007 Rodgers, Jr.
7,217,224 B2 5/2007 Thomas
7,223,209 B2 5/2007 Lee
7,226,394 B2 6/2007 Johnson
7,226,399 B2 6/2007 Lanoue
7,238,146 B1 7/2007 Chen
7,244,217 B2 7/2007 Rodgers, Jr.
7,244,220 B2 7/2007 Carney
7,252,624 B2 8/2007 Wu
7,252,627 B2 8/2007 Carter
7,255,665 B2 8/2007 Ish, III
7,264,576 B2 9/2007 Gerschefske et al.
7,267,637 B2 9/2007 Mercado
7,267,638 B2 9/2007 Wang
7,270,625 B2 9/2007 Miller
RE39,904 E 10/2007 Lee
7,276,017 B2 10/2007 Lin
7,278,955 B2 10/2007 Giannelli et al.
7,278,958 B2 10/2007 Morgan
7,285,075 B2 10/2007 Cutler et al.
7,292,151 B2 11/2007 Ferguson
7,300,387 B2 11/2007 Wang
7,303,508 B2 12/2007 Toyama et al.
7,303,510 B2 12/2007 Gebhardt
7,316,632 B2 1/2008 Rodgers
7,316,633 B2 1/2008 Liao et al.
7,319,457 B2 1/2008 Lin et al.
7,322,907 B2 1/2008 Bowser
7,331,911 B2 2/2008 Webber et al.
7,335,135 B2 2/2008 Wang
7,335,140 B2 2/2008 Webber et al.
7,341,542 B2 3/2008 Ohrt et al.
7,347,806 B2 3/2008 Nakano et al.
7,350,787 B2 4/2008 Voss
7,352,365 B2 4/2008 Trachte
7,354,380 B2 4/2008 Volpe, Jr.
7,357,756 B2 4/2008 Demas
7,361,122 B2 4/2008 Porth
7,361,125 B2 4/2008 Webber et al.
7,367,925 B2 5/2008 Hsu
7,369,121 B2 5/2008 Lane
7,373,510 B2 5/2008 Lamberton et al.
7,374,522 B2 5/2008 Arnold
7,375,450 B2 5/2008 Tanaka et al.
7,377,879 B1 5/2008 Lin
7,377,881 B2 5/2008 Moon
7,381,164 B2 6/2008 Smith et al.
7,393,308 B1 7/2008 Huang
7,402,145 B1 7/2008 Woggon
7,410,449 B2 8/2008 Yeh
7,422,548 B1 9/2008 Teng
7,425,188 B2 9/2008 Ercanbrack
7,435,202 B2 10/2008 Daly et al.
7,435,204 B2 10/2008 Wu et al.
7,438,670 B2 10/2008 Gray et al.
7,438,673 B1 10/2008 Jones
7,451,848 B2 11/2008 Flowers et al.
7,455,624 B2 11/2008 Liao Lai
7,455,626 B2 11/2008 Trevino et al.
7,462,134 B2 12/2008 Lull et al.
7,462,135 B2 12/2008 Lo
7,468,021 B2 12/2008 Moon
7,479,093 B1 1/2009 Immordino et al.
7,485,072 B2 2/2009 Chuang
7,491,154 B2 2/2009 Yonehana et al.

(56) References Cited

U.S. PATENT DOCUMENTS

| | | | |
|---|---|---|---|
| 7,494,447 | B2 | 2/2009 | Eschenbach |
| 7,494,448 | B2 | 2/2009 | Eschenbach |
| 7,494,449 | B2 | 2/2009 | Eschenbach |
| 7,494,450 | B2 | 2/2009 | Solomon |
| 7,507,184 | B2 | 3/2009 | Rodgers, Jr. |
| 7,507,186 | B2 | 3/2009 | Stearns |
| 7,507,188 | B2 | 3/2009 | Nurre |
| 7,510,508 | B2 | 3/2009 | Santomassimo et al. |
| 7,513,853 | B1 | 4/2009 | Russ |
| 7,513,854 | B1 | 4/2009 | Stearns |
| 7,513,855 | B1 | 4/2009 | Yeh |
| 7,517,303 | B2 | 4/2009 | Crawford et al. |
| 7,520,839 | B2 | 4/2009 | Rodgers, Jr. |
| 7,530,926 | B2 | 5/2009 | Rodgers, Jr. |
| 7,530,932 | B2 | 5/2009 | Lofgren et al. |
| 7,547,267 | B1 | 6/2009 | Wang |
| 7,549,947 | B2 | 6/2009 | Hickman et al. |
| 7,549,949 | B2 | 6/2009 | Webber et al. |
| 7,553,260 | B2 | 6/2009 | Piaget et al. |
| 7,556,591 | B2 | 7/2009 | Chuang |
| 7,559,879 | B2 | 7/2009 | Anderson et al. |
| 7,563,203 | B2 | 7/2009 | Dalebout et al. |
| 7,563,209 | B2 | 7/2009 | Webber et al. |
| 7,569,004 | B2 | 8/2009 | Kolomeir |
| 7,572,205 | B1 | 8/2009 | Cribar |
| 7,575,537 | B2 | 8/2009 | Ellis |
| 7,578,770 | B2 | 8/2009 | Kuivala |
| 7,585,258 | B2 | 9/2009 | Watson et al. |
| 7,585,263 | B2 | 9/2009 | Brown et al. |
| 7,591,761 | B1 | 9/2009 | Ellis |
| 7,594,877 | B2 | 9/2009 | Anderson et al. |
| 7,594,878 | B1 | 9/2009 | Joannou |
| 7,594,879 | B2 | 9/2009 | Johnson |
| 7,594,880 | B2 | 9/2009 | Webber |
| 7,601,082 | B2 | 10/2009 | Dizazzo |
| 7,601,187 | B2 | 10/2009 | Webber |
| 7,604,573 | B2 | 10/2009 | Dalebout et al. |
| 7,608,018 | B2 | 10/2009 | Chuang |
| 7,608,019 | B1 | 10/2009 | Stearns |
| 7,611,445 | B2 | 11/2009 | Brown et al. |
| 7,611,446 | B2 | 11/2009 | Chuang |
| 7,618,328 | B2 | 11/2009 | Davenport |
| 7,618,350 | B2 | 11/2009 | Dalebout et al. |
| 7,618,351 | B2 | 11/2009 | Kwon |
| 7,621,850 | B2 | 11/2009 | Piaget et al. |
| 7,625,314 | B2 | 12/2009 | Ungari |
| 7,625,320 | B2 | 12/2009 | Wehrell |
| 7,625,323 | B1 | 12/2009 | Lin |
| 7,632,220 | B2 | 12/2009 | Nelson et al. |
| 7,641,598 | B2 | 1/2010 | Rodgers, Jr. |
| 7,645,213 | B2 | 1/2010 | Watterson |
| 7,645,214 | B2 | 1/2010 | Lull |
| 7,645,215 | B2 | 1/2010 | Gordon |
| 7,648,446 | B2 | 1/2010 | Chiles et al. |
| 7,651,450 | B2 | 1/2010 | Wehrell |
| 7,654,938 | B2 | 2/2010 | Webber et al. |
| 7,654,940 | B2 | 2/2010 | Webber et al. |
| 7,658,698 | B2 | 2/2010 | Pacheco et al. |
| 7,662,069 | B2 | 2/2010 | Maresh |
| 7,665,388 | B2 | 2/2010 | Lin |
| 7,670,266 | B2 | 3/2010 | Cornejo |
| 7,670,269 | B2 | 3/2010 | Webber et al. |
| 7,674,205 | B2 | 3/2010 | Dalebout et al. |
| 7,678,025 | B2 | 3/2010 | Rodgers, Jr. |
| 7,682,286 | B2 | 3/2010 | Badarneh et al. |
| 7,682,287 | B1 | 3/2010 | Hsieh |
| 7,682,288 | B1 | 3/2010 | Stearns |
| 7,682,289 | B2 | 3/2010 | Chen |
| 7,682,290 | B2 | 3/2010 | Liao et al. |
| 7,686,750 | B2 | 3/2010 | Tuller |
| 7,691,031 | B2 | 4/2010 | Toyama et al. |
| 7,691,034 | B2 | 4/2010 | May et al. |
| 7,695,406 | B2 | 4/2010 | Waters |
| 7,704,191 | B2 | 4/2010 | Hsieh |
| 7,704,192 | B2 | 4/2010 | Dyer et al. |
| 7,706,547 | B2 | 4/2010 | Luo |
| 7,708,669 | B2 | 5/2010 | Rodgers, Jr. |
| 7,708,670 | B2 | 5/2010 | Bowser |
| 7,713,171 | B1 | 5/2010 | Hickman |
| 7,717,446 | B2 | 5/2010 | Pate et al. |
| 7,717,827 | B2 | 5/2010 | Kurunmäki et al. |
| 7,717,828 | B2 | 5/2010 | Simonson et al. |
| 7,717,832 | B2 | 5/2010 | Webber et al. |
| 7,722,505 | B2 | 5/2010 | Liao et al. |
| 7,727,120 | B2 | 6/2010 | Smith |
| 7,727,122 | B2 | 6/2010 | Kuo |
| 7,727,125 | B2 | 6/2010 | Day |
| 7,731,634 | B2 | 6/2010 | Stewart et al. |
| 7,731,635 | B2 | 6/2010 | Dyer |
| 7,736,272 | B2 | 6/2010 | Martens |
| 7,736,278 | B2 | 6/2010 | Lull et al. |
| 7,736,279 | B2 | 6/2010 | Dalebout et al. |
| 7,736,281 | B2 | 6/2010 | Corbalis et al. |
| 7,736,286 | B2 | 6/2010 | Panaiotov |
| 7,740,563 | B2 | 6/2010 | Dalebout et al. |
| 7,741,975 | B2 | 6/2010 | Shum et al. |
| 7,745,716 | B1 | 6/2010 | Murphy |
| 7,749,137 | B2 | 7/2010 | Watt et al. |
| 7,753,824 | B2 | 7/2010 | Wang |
| 7,758,469 | B2 | 7/2010 | Dyer et al. |
| 7,764,990 | B2 | 7/2010 | Martikka et al. |
| 7,766,797 | B2 | 8/2010 | Dalebout |
| 7,766,802 | B2 | 8/2010 | Webber et al. |
| 7,771,325 | B2 | 8/2010 | Baker |
| 7,775,940 | B2 | 8/2010 | Dalebout et al. |
| 7,775,947 | B2 | 8/2010 | Towley, III et al. |
| 7,780,577 | B2 | 8/2010 | Arnold |
| 7,780,583 | B2 | 8/2010 | Brown |
| 7,785,235 | B2 | 8/2010 | Towley, III et al. |
| 7,789,800 | B1 | 9/2010 | Watterson et al. |
| 7,789,806 | B2 | 9/2010 | Yang |
| 7,789,841 | B2 | 9/2010 | Huckle |
| 7,794,361 | B2 | 9/2010 | Wang |
| 7,794,362 | B2 | 9/2010 | Miller |
| 7,794,371 | B2 | 9/2010 | Webber et al. |
| 7,798,910 | B2 | 9/2010 | Leadbetter |
| 7,803,096 | B2 | 9/2010 | Mehta |
| 7,805,186 | B2 | 9/2010 | Pulkkinen et al. |
| 7,806,805 | B2 | 10/2010 | Barufka et al. |
| 7,806,807 | B2 | 10/2010 | Genua |
| 7,811,206 | B2 | 10/2010 | Chuang |
| 7,811,207 | B2 | 10/2010 | Stearns |
| 7,811,211 | B2 | 10/2010 | Habing |
| 7,815,549 | B2 | 10/2010 | Crawford et al. |
| 7,815,550 | B2 | 10/2010 | Watterson et al. |
| 7,824,314 | B2 | 11/2010 | Maresh |
| 7,825,319 | B2 | 11/2010 | Turner |
| 7,828,698 | B2 | 11/2010 | Rodgers, Jr. |
| 7,828,703 | B1 | 11/2010 | Boesch |
| 7,837,595 | B2 | 11/2010 | Rice |
| 7,841,964 | B2 | 11/2010 | Radow |
| 7,841,968 | B1 | 11/2010 | Eschenbach |
| 7,846,070 | B2 | 12/2010 | Oglesby et al. |
| 7,846,071 | B2 | 12/2010 | Fenster et al. |
| 7,850,537 | B2 | 12/2010 | Stern |
| 7,854,691 | B2 | 12/2010 | Long et al. |
| 7,857,731 | B2 | 12/2010 | Jacobs et al. |
| 7,862,476 | B2 | 1/2011 | Radow |
| 7,862,478 | B2 | 1/2011 | Watterson et al. |
| 7,862,483 | B2 | 1/2011 | Watterson et al. |
| 7,862,484 | B1 | 1/2011 | Coffey |
| 7,867,146 | B2 | 1/2011 | Ge et al. |
| 7,871,355 | B2 | 1/2011 | Yeh |
| 7,871,356 | B2 | 1/2011 | Smith |
| 7,874,963 | B2 | 1/2011 | Grind |
| 7,878,951 | B2 | 2/2011 | Roman et al. |
| 7,878,953 | B2 | 2/2011 | Webber et al. |
| 7,883,448 | B2 | 2/2011 | Wang |
| 7,883,451 | B2 | 2/2011 | Hand |
| 7,887,465 | B2 | 2/2011 | Uffelman |
| 7,901,330 | B2 | 3/2011 | Dalebout et al. |
| 7,901,335 | B2 | 3/2011 | Webber et al. |
| 7,901,338 | B2 | 3/2011 | Gerschefske |
| 7,909,739 | B2 | 3/2011 | Kwon et al. |

(56) References Cited

U.S. PATENT DOCUMENTS 7,909,740 B2 3/2011 Dalebout et al.
7,918,766 B2 4/2011 Lu et al.
7,918,768 B2 4/2011 Rogozinski
7,918,773 B2 4/2011 Brennan
7,922,625 B2 4/2011 Lu et al.
7,922,632 B2 4/2011 Chou
7,926,834 B2 4/2011 Willis
7,927,257 B2 4/2011 Patel
7,935,027 B2 5/2011 Graber
7,938,754 B2 5/2011 Eschenbach
7,938,760 B1 5/2011 Webber et al.
7,942,787 B2 5/2011 Ohrt et al.
7,946,959 B2 5/2011 Shum et al.
7,946,962 B2 5/2011 Long
7,951,048 B1 5/2011 Hsiung
7,955,225 B1 6/2011 James
7,955,234 B1 6/2011 Pursley
7,963,889 B2 6/2011 Badarneh et al.
7,967,709 B2 6/2011 Emura
7,967,736 B2 6/2011 D'Silva et al.
7,972,245 B2 7/2011 Temple et al.
7,972,248 B2 7/2011 Liao
7,976,440 B2 7/2011 Webber et al.
7,978,081 B2 7/2011 Shears et al.
7,981,010 B1 7/2011 Webber et al.
7,981,015 B2 7/2011 Reed
7,985,164 B2 7/2011 Reed
7,985,165 B1 7/2011 Lin et al.
7,985,191 B2 7/2011 Trandafir
7,988,600 B2 8/2011 Rodgers, Jr.
7,993,251 B1 8/2011 Webber et al.
8,001,472 B2 8/2011 Gilley et al.
8,002,674 B2 8/2011 Piaget et al.
8,002,684 B2 8/2011 Laurent
8,007,422 B2 8/2011 Zaccherini
RE42,698 E 9/2011 Kuo et al.
8,012,003 B2 9/2011 Sterchi et al.
8,012,067 B2 9/2011 Joannou
8,021,275 B2 9/2011 Rodgers, Jr.
8,025,609 B2 9/2011 Giannelli et al.
8,025,610 B2 9/2011 Chang
8,029,415 B2 10/2011 Ashby et al.
8,033,961 B2 10/2011 Kuo
8,047,965 B2 11/2011 Shea
8,047,968 B2 11/2011 Stewart
8,051,359 B2 11/2011 Lin et al.
8,057,366 B2 11/2011 Schippers
8,062,187 B2 11/2011 Lull et al.
8,062,190 B2 11/2011 Pyles et al.
8,063,776 B2 11/2011 Ruha
8,079,937 B2 12/2011 Bedell
8,088,044 B2 1/2012 Tchao et al.
8,103,517 B2 1/2012 Hinnebusch
8,105,213 B2 1/2012 Stewart et al.
8,109,858 B2 2/2012 Redmann
8,113,990 B2 2/2012 Kolman et al.
8,113,995 B1 2/2012 Hsu
8,123,527 B2 2/2012 Holljes
8,133,159 B2 3/2012 Eschenbach
8,137,247 B2 3/2012 Gerschefske et al.
8,147,385 B2 4/2012 Crawford et al.
8,162,804 B2 4/2012 Tagliabue
8,167,734 B2 5/2012 Boldin
8,177,692 B2 5/2012 Deppen
8,177,693 B2 5/2012 Webber et al.
8,187,124 B2 5/2012 Ciesar
8,200,323 B2 6/2012 Dibenedetto et al.
8,202,204 B2 6/2012 Celone
8,206,266 B2 6/2012 Hall
8,206,272 B2 6/2012 Greene
8,210,993 B2 7/2012 Lee et al.
8,210,997 B2 7/2012 Thomas
8,215,027 B2 7/2012 Kang
8,221,290 B2 7/2012 Vincent et al.
8,235,724 B2 8/2012 Gilley et al.
8,235,873 B1 8/2012 Stearns
8,241,182 B2 8/2012 Julskjaer et al.
8,241,186 B2 8/2012 Brodess et al.
8,251,874 B2 8/2012 Ashby et al.
8,257,228 B2 9/2012 Quatrochi et al.
8,257,230 B2 9/2012 Chen et al.
8,260,858 B2 9/2012 Belz et al.
8,272,996 B2 9/2012 Weier
8,287,434 B2 10/2012 Zavadsky et al.
8,306,635 B2 11/2012 Pryor
8,317,663 B2 11/2012 Stewart et al.
8,320,578 B2 11/2012 Kahn et al.
8,323,155 B2 12/2012 Ohrt et al.
8,333,681 B2 12/2012 Schmidt
8,343,016 B1 1/2013 Astilean
8,360,904 B2 1/2013 Oleson et al.
8,376,913 B2 2/2013 Lee et al.
8,403,815 B2 3/2013 Liao et al.
8,403,818 B1 3/2013 Wilkinson et al.
8,409,058 B2 4/2013 Gordon et al.
8,419,598 B2 4/2013 Dyer et al.
8,429,223 B2 4/2013 Gilley et al.
8,435,129 B2 5/2013 Miller
8,439,810 B2 5/2013 Baudhuin
8,469,861 B1 6/2013 McFee
8,485,945 B2 7/2013 Leonhard
8,487,759 B2 7/2013 Hill
8,533,620 B2 9/2013 Hoffman et al.
8,540,584 B1 9/2013 Sorenson
8,550,962 B2 10/2013 Piaget et al.
8,552,859 B2 10/2013 Pakula et al.
8,556,779 B2 10/2013 Grind
8,556,780 B2 10/2013 Chen
8,562,489 B2 10/2013 Burton et al.
8,562,491 B2 10/2013 Merli
8,562,496 B2 10/2013 Webber et al.
8,585,561 B2 11/2013 Watt et al.
8,597,093 B2 12/2013 Engelberg et al.
8,603,017 B2 12/2013 Trandafir et al.
8,647,239 B1 2/2014 Sokolovas
8,647,240 B2 2/2014 Heidecke
8,647,241 B2 * 2/2014 Walton ..... A61H 1/0214 482/57
8,655,004 B2 2/2014 Prest et al.
8,663,070 B2 3/2014 Long
8,668,627 B2 3/2014 Eschenbach
8,702,430 B2 4/2014 Dibenedetto et al.
8,724,037 B1 5/2014 Massey
8,727,947 B2 5/2014 Tagliabue
8,734,157 B1 5/2014 Hummel, III
8,734,298 B2 5/2014 Murray
8,734,304 B2 5/2014 Webber et al.
8,738,321 B2 5/2014 Yuen et al.
8,740,754 B2 6/2014 Miller
8,771,151 B2 7/2014 Larsson
8,786,575 B2 7/2014 Miller
8,795,139 B2 8/2014 Zhang et al.
8,795,210 B2 8/2014 Talish et al.
8,801,578 B2 8/2014 Corbalis et al.
8,801,580 B1 8/2014 Maresh
8,801,582 B2 8/2014 Huang et al.
8,814,757 B2 8/2014 Eschenbach
8,821,354 B1 9/2014 Tabahi
8,824,697 B2 9/2014 Christoph
8,827,879 B2 9/2014 Nicholas
8,834,323 B2 9/2014 Chen
8,845,493 B2 9/2014 Watterson et al.
8,847,988 B2 9/2014 Geisner et al.
8,864,092 B2 10/2014 Newville
8,864,608 B2 10/2014 Rockhill
8,864,627 B2 10/2014 Bayerlein et al.
8,864,631 B1 10/2014 Stearns
8,876,669 B2 11/2014 Vujicic
8,892,999 B2 11/2014 Nims et al.
8,893,698 B2 11/2014 Boehner
8,894,549 B2 11/2014 Colledge
8,926,478 B2 1/2015 Abuelsaad et al.
8,939,831 B2 1/2015 Dugan

(56) References Cited

U.S. PATENT DOCUMENTS 8,951,168 B2 * 2/2015 Baudhuin ..... A63B 71/0622 482/57
8,956,290 B2 2/2015 Gilley et al.
8,974,352 B2 3/2015 Eschenbach
8,979,713 B2 3/2015 Huang et al.
8,986,165 B2 3/2015 Ashby
8,990,732 B2 3/2015 Farrenkopf et al.
8,992,364 B2 3/2015 Law et al.
8,996,978 B2 3/2015 Richstein et al.
9,005,224 B2 4/2015 Euteneuer et al.
9,011,291 B2 4/2015 Birrell
9,017,223 B2 4/2015 Eschenbach
9,039,577 B2 5/2015 Peng
9,039,578 B2 5/2015 Dalebout
9,039,581 B2 5/2015 Chia et al.
9,044,635 B2 6/2015 Lull
9,050,485 B2 6/2015 Huang et al.
9,050,486 B2 6/2015 Reed
9,050,491 B2 6/2015 Gordon et al.
9,050,498 B2 6/2015 Lu et al.
9,061,175 B1 6/2015 Miller et al.
9,072,936 B1 7/2015 Miller et al.
9,081,534 B2 7/2015 Yuen et al.
9,084,565 B2 7/2015 Mason et al.
9,088,450 B2 7/2015 Jung et al.
9,108,081 B2 8/2015 Giannelli et al.
9,114,275 B2 8/2015 Lu et al.
9,114,276 B2 8/2015 Bayerlein et al.
9,132,330 B2 9/2015 Brendle
9,138,614 B2 9/2015 Lu et al.
9,148,077 B2 9/2015 Henderson
9,162,106 B1 10/2015 Scheiman
9,174,085 B2 11/2015 Foley
9,198,622 B2 12/2015 Kaleal et al.
9,199,115 B2 12/2015 Yim et al.
9,227,103 B2 1/2016 Yang
9,248,071 B1 2/2016 Benda et al.
9,248,338 B2 2/2016 Lo
9,254,413 B2 2/2016 Chen et al.
9,254,414 B2 2/2016 Liu et al.
9,259,610 B2 2/2016 Huang et al.
9,272,180 B2 3/2016 Eschenbach
9,275,504 B1 3/2016 Cooper
9,278,249 B2 3/2016 Watterson
9,278,250 B2 3/2016 Buchanan
9,289,648 B2 3/2016 Watterson
9,295,765 B2 3/2016 Muri et al.
9,302,148 B1 4/2016 Vujicic et al.
9,308,415 B2 4/2016 Crawford et al.
9,330,544 B2 5/2016 Levesque et al.
9,358,422 B2 6/2016 Brontman
9,364,708 B2 6/2016 Luger et al.
9,367,668 B2 6/2016 Flynt et al.
9,375,606 B1 6/2016 Maresh
9,378,336 B2 6/2016 Ohnemus et al.
9,381,394 B2 7/2016 Mortensen et al.
9,387,387 B2 7/2016 Mortensen et al.
9,389,718 B1 7/2016 Letourneur
9,392,941 B2 7/2016 Powch et al.
9,411,940 B2 8/2016 Burroughs et al.
9,421,416 B2 8/2016 Mortensen et al.
9,452,320 B2 9/2016 Yang
9,457,222 B2 10/2016 Dalebout
9,457,223 B2 10/2016 Eschenbach
9,457,224 B2 10/2016 Giannelli et al.
9,457,256 B2 10/2016 Aragones et al.
9,468,797 B1 10/2016 Miller
9,474,925 B1 10/2016 Hsiung
9,492,704 B2 11/2016 Mortensen et al.
9,498,700 B2 11/2016 Henrie et al.
9,511,253 B1 12/2016 Miller
9,517,812 B2 12/2016 Tetsuka
9,539,458 B1 1/2017 Ross
9,545,540 B1 1/2017 Moschel
9,566,469 B1 2/2017 Rector
9,579,534 B2 2/2017 Sutkowski et al.
9,586,085 B2 3/2017 Arnold et al.
9,586,086 B2 3/2017 Dalebout et al.
9,586,087 B1 3/2017 Lin
9,597,540 B2 3/2017 Arnold
9,604,099 B2 3/2017 Taylor
9,610,475 B1 4/2017 DeKnock et al.
9,610,490 B2 4/2017 Tambornino et al.
9,623,286 B1 4/2017 Chen
9,625,091 B1 4/2017 Massey
9,636,540 B2 5/2017 Mueller et al.
9,636,541 B1 5/2017 Hsu
9,649,524 B2 5/2017 Giunchi
9,649,529 B1 5/2017 Miller
9,682,306 B2 6/2017 Lin et al.
9,700,780 B2 7/2017 Riley et al.
9,707,439 B2 7/2017 Lee et al.
9,707,443 B2 7/2017 Warren
9,707,447 B1 7/2017 Lopez Babodilla
9,750,343 B2 9/2017 McBride et al.
9,757,605 B2 9/2017 Olson et al.
9,757,611 B1 9/2017 Colburn
9,757,614 B1 9/2017 Giannelli et al.
9,782,625 B1 10/2017 Blum et al.
9,808,667 B2 11/2017 Liao et al.
9,808,673 B2 11/2017 Robinson
9,827,458 B2 11/2017 Dalton
9,839,808 B1 12/2017 McNeil
9,845,133 B2 12/2017 Craven et al.
9,878,201 B1 1/2018 Moschel
9,886,458 B2 2/2018 Jung et al.
9,889,334 B2 2/2018 Ashby et al.
9,901,772 B2 2/2018 Crowley et al.
9,901,774 B2 2/2018 Miller et al.
9,901,780 B2 2/2018 DeLuca et al.
9,919,183 B1 3/2018 Moschel
9,925,411 B2 3/2018 Huang et al.
9,937,376 B2 4/2018 McInelly et al.
9,937,377 B2 4/2018 McInelly et al.
9,937,378 B2 4/2018 Dalebout et al.
9,937,380 B2 4/2018 Giannelli et al.
9,950,204 B2 4/2018 Eisenblaetter
9,950,209 B2 4/2018 Yim et al.
9,968,821 B2 5/2018 Finlayson et al.
9,981,153 B2 5/2018 Chou
9,987,513 B2 6/2018 Yim et al.
9,990,126 B2 6/2018 Chanyontpatanakul
9,993,680 B2 6/2018 Gordon
9,993,683 B2 6/2018 Moschel
9,993,684 B2 6/2018 Lin et al.
9,999,818 B2 6/2018 Hawkins, III et al.
10,004,945 B2 6/2018 Sauter
10,029,143 B1 7/2018 Milstein
10,039,951 B2 8/2018 Chang
10,039,970 B2 8/2018 Lee et al.
10,046,202 B2 8/2018 Butler, Jr. et al.
10,080,918 B2 9/2018 Dalmia
2001/0001303 A1 5/2001 Ohsuga et al.
2001/0016542 A1 8/2001 Yoshimura
2002/0004439 A1 1/2002 Galbraith et al.
2002/0055422 A1 5/2002 Airmet
2002/0077221 A1 6/2002 Dalebout et al.
2002/0086779 A1 7/2002 Wilkinson
2002/0173412 A1 11/2002 Stearns
2003/0073545 A1 4/2003 Liu
2003/0083177 A1 5/2003 Tung
2003/0092532 A1 5/2003 Giannelli et al.
2003/0148853 A1 8/2003 Alessandri
2003/0171189 A1 9/2003 Kaufman
2003/0171190 A1 9/2003 Rice
2003/0197110 A1 10/2003 Cui
2004/0023726 A1 2/2004 Ritson
2004/0023736 A1 2/2004 Cardinale
2004/0043871 A1 3/2004 Chang
2004/0058784 A1 3/2004 Roberts
2004/0063519 A1 4/2004 Liberatore
2004/0067822 A1 4/2004 Sher
2004/0077463 A1 4/2004 Rodgers
2004/0147375 A1 7/2004 Stevens

(56) References Cited

U.S. PATENT DOCUMENTS

2004/0157706 A1 8/2004 Miller
2004/0162194 A1 8/2004 Habing
2004/0180719 A1 9/2004 Feldman
2004/0204294 A2 10/2004 Wilkinson
2004/0224740 A1 11/2004 Ball et al.
2005/0009668 A1 1/2005 Savettiere
2005/0049117 A1 3/2005 Rodgers
2005/0054254 A1 3/2005 Erickson et al.
2005/0054459 A1 3/2005 Oldenburg
2005/0075217 A1 4/2005 Stevens
2005/0085352 A1 4/2005 Baxter
2005/0101445 A1 5/2005 Chen
2005/0101463 A1 5/2005 Chen
2005/0143226 A1 6/2005 Heidecke
2005/0172311 A1 8/2005 Hjelt et al.
2005/0181347 A1 8/2005 Barnes et al.
2005/0209050 A1 9/2005 Bartels
2005/0245370 A1 11/2005 Boland
2005/0264112 A1 12/2005 Tanaka et al.
2005/0272562 A1 12/2005 Alessandri et al.
2005/0272568 A1 12/2005 Wang
2005/0272577 A1 12/2005 Olson
2006/0003869 A1 1/2006 Huang et al.
2006/0019802 A1 1/2006 Caird
2006/0019804 A1 1/2006 Young
2006/0025246 A1 2/2006 Forney
2006/0040810 A1 2/2006 Chu
2006/0052727 A1 3/2006 Palestrant
2006/0063644 A1 3/2006 Yang
2006/0106424 A1 5/2006 Bachem
2006/0122035 A1 6/2006 Felix
2006/0128533 A1 6/2006 Ma
2006/0166791 A1 7/2006 Liao
2006/0172862 A1 8/2006 Badarneh et al.
2006/0183606 A1 8/2006 Parmater
2006/0189446 A1 8/2006 Rogus
2006/0194679 A1 8/2006 Hatcher
2006/0205568 A1 9/2006 Huang
2006/0211549 A1 9/2006 Nohejl
2006/0217240 A1 9/2006 White
2006/0223678 A1 10/2006 Maclean
2006/0240947 A1 10/2006 Qu
2006/0264286 A1 11/2006 Hodjat
2006/0281604 A1 12/2006 Stewart et al.
2006/0287089 A1 12/2006 Addington et al.
2006/0288846 A1 12/2006 Logan
2006/0293153 A1 12/2006 Porth
2007/0004562 A1 1/2007 Pan et al.
2007/0015633 A1 1/2007 Gerschefske et al.
2007/0021276 A1* 1/2007 Kuo ..... A63B 21/005 482/62
2007/0034625 A1 2/2007 Pacheco
2007/0038137 A1 2/2007 Arand et al.
2007/0042868 A1 2/2007 Fisher
2007/0049467 A1 3/2007 Lin
2007/0060449 A1 3/2007 Lo
2007/0072156 A1 3/2007 Kaufman et al.
2007/0087906 A1 4/2007 Rodgers, Jr.
2007/0087907 A1 4/2007 Rodgers, Jr.
2007/0099764 A1* 5/2007 Eschenbach ..... A63B 22/001 482/52
2007/0111858 A1 5/2007 Dugan
2007/0117683 A1 5/2007 Ercanbrack et al.
2007/0123390 A1 5/2007 Mathis
2007/0135268 A1 6/2007 Wang
2007/0135269 A1 6/2007 Wang
2007/0142175 A1 6/2007 Morgan
2007/0142183 A1 6/2007 Chang
2007/0155277 A1 7/2007 Amitai et al.
2007/0161467 A1 7/2007 Lee
2007/0190508 A1 8/2007 Dalton
2007/0197355 A1 8/2007 Brown
2007/0202994 A1 8/2007 Alessandri
2007/0208280 A1 9/2007 Talish
2007/0225119 A1 9/2007 Schenk
2007/0227409 A1 10/2007 Chu
2007/0232467 A1 10/2007 Puzey
2007/0238580 A1 10/2007 Wang
2007/0238582 A1 10/2007 Lee
2007/0238584 A1 10/2007 Lee
2007/0270667 A1 11/2007 Coppi et al.
2007/0270726 A1 11/2007 Chou
2007/0271116 A1 11/2007 Wysocki et al.
2007/0281828 A1 12/2007 Rice
2007/0293336 A1 12/2007 Ferguson
2007/0298935 A1 12/2007 Badarneh
2007/0298937 A1 12/2007 Shah
2008/0004163 A1 1/2008 Husted
2008/0020907 A1 1/2008 Lin
2008/0026838 A1 1/2008 Dunstan et al.
2008/0032864 A1 2/2008 Hakki
2008/0046246 A1 2/2008 Hakki
2008/0051256 A1 2/2008 Ashby et al.
2008/0064571 A1 3/2008 Lee
2008/0064572 A1 3/2008 Nardone
2008/0070755 A1 3/2008 Mckee
2008/0076639 A1 3/2008 Fon
2008/0076972 A1 3/2008 Dorogusker et al.
2008/0085819 A1 4/2008 Yang et al.
2008/0103024 A1 5/2008 Habing
2008/0108457 A1 5/2008 Hansen
2008/0108917 A1 5/2008 Joutras et al.
2008/0119333 A1* 5/2008 Bowser ..... A63B 21/055 482/62
2008/0139370 A1 6/2008 Charnitski
2008/0155077 A1 6/2008 James
2008/0161163 A1 7/2008 Stewart et al.
2008/0161166 A1 7/2008 Lo
2008/0191864 A1 8/2008 Wolfson
2008/0207407 A1 8/2008 Yeh
2008/0214971 A1 9/2008 Talish
2008/0220945 A1* 9/2008 Chen ..... A63B 21/015 482/57
2008/0242511 A1 10/2008 Munoz et al.
2008/0261778 A1 10/2008 Chuang
2008/0269024 A1 10/2008 Lin
2008/0279896 A1 11/2008 Heinen et al.
2008/0280733 A1 11/2008 Dickie et al.
2008/0280734 A1 11/2008 Dickie et al.
2008/0280735 A1 11/2008 Dickie et al.
2008/0293488 A1 11/2008 Cheng et al.
2008/0318738 A1 12/2008 Chen
2009/0029831 A1 1/2009 Weier
2009/0048493 A1 2/2009 James et al.
2009/0062080 A1 3/2009 Guy
2009/0069159 A1 3/2009 Wang
2009/0093346 A1 4/2009 Nelson et al.
2009/0093347 A1 4/2009 Wang
2009/0098981 A1 4/2009 Del Giorno
2009/0105548 A1 4/2009 Bart
2009/0111663 A1 4/2009 Kuo
2009/0111670 A1 4/2009 Williams
2009/0118098 A1 5/2009 Yeh
2009/0124463 A1 5/2009 Lin
2009/0124465 A1 5/2009 Wang
2009/0128516 A1 5/2009 Rimon et al.
2009/0144080 A1 6/2009 Gray et al.
2009/0170671 A1 7/2009 Faktenmark
2009/0180646 A1 7/2009 Vulfson et al.
2009/0181831 A1 7/2009 Kuo
2009/0221405 A1 9/2009 Wang
2009/0221407 A1 9/2009 Hauk
2009/0239714 A1* 9/2009 Sellers ..... A63B 22/001 482/52
2009/0253559 A1 10/2009 Maresh
2009/0269728 A1 10/2009 Verstegen et al.
2010/0022354 A1 1/2010 Fisher
2010/0035726 A1 2/2010 Fisher et al.
2010/0064255 A1 3/2010 Rottler et al.
2010/0077564 A1 4/2010 Saier et al.
2010/0081548 A1 4/2010 Labedz
2010/0156760 A1 6/2010 Cheswick
2010/0167881 A1 7/2010 Day
2010/0210418 A1 8/2010 Park

(56) References Cited

U.S. PATENT DOCUMENTS

2010/0240458 A1 9/2010 Gaiba et al.
2010/0242246 A1 9/2010 Dalebout et al.
2010/0263476 A1 10/2010 Peschmann
2010/0279822 A1 11/2010 Ford
2010/0311552 A1 12/2010 Sumners
2011/0017168 A1 1/2011 Gilpatrick
2011/0021325 A1 1/2011 Summers
2011/0087137 A1 4/2011 Hanoun
2011/0092343 A1 4/2011 Habing
2011/0093100 A1 4/2011 Ramsay
2011/0130256 A1 6/2011 Evans
2011/0131005 A1 6/2011 Ueshima et al.
2011/0143769 A1 6/2011 Jones et al.
2011/0152696 A1 6/2011 Ryan
2011/0273552 A1 11/2011 Wang et al.
2012/0010053 A1 1/2012 Bayerlein et al.
2012/0071301 A1 3/2012 Kaylor et al.
2012/0088640 A1 4/2012 Wissink
2012/0108397 A1 5/2012 Tsai
2012/0108402 A1 5/2012 Rodgers, Jr.
2012/0184417 A1 7/2012 Yablonowski
2012/0196726 A1 8/2012 Larsson
2012/0230504 A1 9/2012 Kuroda
2012/0242774 A1 9/2012 Numano et al.
2012/0253489 A1 10/2012 Dugan
2012/0258433 A1 10/2012 Hope et al.
2012/0322623 A1 12/2012 Lai
2012/0322625 A1 12/2012 Park
2013/0059697 A1 3/2013 Chuang
2013/0061714 A1 3/2013 Hsiung
2013/0143717 A1 6/2013 Wang
2013/0172151 A1 7/2013 Wang
2013/0225377 A1 8/2013 Lee et al.
2013/0228063 A1 9/2013 Turner
2013/0237383 A1 9/2013 Chen
2013/0303297 A1 11/2013 Mackie
2013/0346043 A1 12/2013 Mewes et al.
2014/0017963 A1 1/2014 Lazarovits
2014/0024499 A1 1/2014 Watterson
2014/0051552 A1 2/2014 Habing et al.
2014/0056461 A1 2/2014 Afshar
2014/0073488 A1 3/2014 Wu
2014/0085077 A1 3/2014 Luna et al.
2014/0123325 A1 5/2014 Jung et al.
2014/0141939 A1 5/2014 Wu
2014/0194260 A1 7/2014 Campanaro et al.
2014/0221165 A1 8/2014 Chuang
2014/0274564 A1 9/2014 Greenbaum
2014/0274574 A1* 9/2014 Shorten ..... A63B 22/0046 482/52
2014/0309086 A1 10/2014 Chuang
2014/0371036 A1 12/2014 Ellis
2015/0003621 A1 1/2015 Trammell
2015/0004579 A1 1/2015 Shelton
2015/0016623 A1 1/2015 Trammell
2015/0069738 A1 3/2015 Knight
2015/0111706 A1 4/2015 Broadhurst
2015/0177083 A1 6/2015 Redmond
2015/0182781 A1 7/2015 Watterson
2015/0182787 A1 7/2015 Liu et al.
2015/0209617 A1 7/2015 Hsiao
2015/0375030 A1 12/2015 Yang et al.
2016/0263426 A1 9/2016 Mueller et al.
2016/0339288 A1 11/2016 Li
2016/0346595 A1 12/2016 Dalebout et al.
2016/0346599 A1 12/2016 Dalebout et al.
2017/0036053 A1 2/2017 Smith et al.
2017/0056709 A1 3/2017 Ercanbrack et al.
2017/0056711 A1 3/2017 Dalebout et al.
2017/0216660 A1 8/2017 Lernihan
2017/0259111 A1 9/2017 Hsieh
2017/0266532 A1 9/2017 Watterson
2017/0266533 A1 9/2017 Dalebout
2017/0312580 A1 11/2017 Chang
2017/0319906 A1 11/2017 Chang et al.
2017/0368442 A1 12/2017 Baudhuin
2018/0056105 A1 3/2018 Ho
2018/0117393 A1 5/2018 Ercanbrack

* cited by examiner

ELLIPTICAL AND STATIONARY BICYCLE APPARATUS INCLUDING ROW FUNCTIONALITY

RELATED APPLICATIONS

This application claims priority to U.S. patent application Ser. No. 62/416,030 titled "Elliptical and Stationary Bicycle Apparatus Including Row Functionality" and filed on 1 Nov. 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Generally, the human body can adequately supply enough oxygen to meet the body's demands at the intensity levels involved with aerobic exercise. Popular forms of aerobic exercise include running, jogging, swimming, and cycling, among others activities. In contrast, anaerobic exercise often involves high intensity exercises over a short duration of time. Popular forms of anaerobic exercise include strength training and short distance running.

Many people choose to perform aerobic exercises indoors, such as in a gym or their home. Often, a user will use an aerobic exercise machine to have an aerobic workout indoors. One such type of aerobic exercise machine is an elliptical exercise machine, which often includes foot supports that move in fixed reciprocating directions when moved by the feet of a user. Often, the foot supports are mechanically linked to arm levers that can be held by the user during the workout. The arm levers and foot supports move together and collectively provide resistance against the user's motion during the user's workout. Other popular exercise machines that allow a user to perform aerobic exercises indoors include treadmills, rowing machines, and stepper machines, to name a few.

Another popular form of aerobic exercise is cycling. Cycling is typically done on stationary bikes indoors or on moving bikes outside that travel off road or on streets. With a traditional upright bicycle, the user rests his or her body weight entirely on a small portion of the bike's seat, handles, and pedals. With an upright bike, the user typically leans forward as he or she pedals. Another form of cycling is recumbent cycling. With a recumbent bicycle, the user is often reclined in a seat with a back support which distributes the user's weight over a larger area, including the user's back.

One system for cycling is disclosed in U.S. Pat. No. 6,071,215 issued to David M. Raffo, et al. In this reference, a multi-mode exercise machine has a re-configurable arm member operable in alternate upstanding and recumbent configurations that allows the machine to be used, when the re-configurable arm member is configured in its upright configuration, to provide a first mode of exercise where the user is supported in such an upright position as to be able to exercise at least his/her lower body, and that allows the machine to be used, when the re-configurable arm member is configured in its recumbent configuration, to provide a second mode of exercise, where the user is supported in such a recumbent position as to allow the user to exercise at least his/her upper body. According to Raffo, the re-configurable arm member includes a pivotally mounted and self-locking arm member movable between a first, upright position and a second, recumbent position. The first and second exercise modes include cycling and rowing exercise modes. Other types of cycling devices are disclosed in U.S. Pat. No. 6,497,426 issued to James L. Vanpelt; U.S. Pat. No. 6,648,353 to Pedro Pablo Cabal; and U.S. Patent Publication No. 2013/0260964 issued to Benjamin Chia.

SUMMARY

In one embodiment, an exercise machine includes a frame, a seat track of the frame, a seat movably attached to the seat of the frame, a first flywheel connected to the frame, a second flywheel connected to the frame, a pull cable in communication with the first flywheel, a crank assembly in communication with the second flywheel, a first swing arm connected to the frame, and a second swing arm connected to the frame.

The exercise machine may include a first magnetic resistance mechanism that resists movement of the first flywheel.

The exercise machine may include a second magnetic resistance mechanism that resists movement of the second flywheel.

The crank assembly may include a crank axle, a first crank arm connected to a first side of the crank axle, a second crank arm connected to a second side of the crank axle, a first crank pedal connected to the first crank arm, and a second crank pedal connected to the second crank arm.

The crank assembly may a crank wheel connected to the crank axle.

The exercise machine may include a transmission medium that transmits torque from the crank wheel to the second flywheel when the crank axle rotates.

The first crank pedal and the second crank pedal may travel in a generally circular path when the crank axle rotates.

The exercise machine may include a base connected to the frame, a first movable linkage pivotally connected to the first side of the crank axle and slidably connected to the base, and a second movable linkage pivotally connected to the second side of the crank axle and slidably connected to the base.

The base may include a first longitudinal track and a second longitudinal track aligned with the first longitudinal track. The first movable linkage connects in the first longitudinal track, and the second movable linkage connects in the second longitudinal track.

The first swing arm may be pivotally connected to the first movable linkage, and the second swing arm may be pivotally connected to the second movable linkage.

The exercise machine may include a first linkage pedal connected to a first mid-region of the first movable linkage and a second linkage pedal connected to a second mid-region of the second movable linkage.

The first linkage pedal and the second linkage pedal may travel in a generally oblong path when the crank axle rotates.

The first longitudinal track and the second longitudinal track may be aligned with the seat track.

The exercise machine may include a handle attached to a first cable end of the pull cable and a cable axle in communication with a second cable end.

The exercise machine may include a transmission medium connecting the cable axle to the first flywheel.

In an embodiment, an exercise machine includes a frame, a seat track of the frame, a seat movably attached to the seat of the frame, a first flywheel connected to the frame, a second flywheel connected to the frame, a pull cable in communication with the first flywheel, a crank assembly in communication with the second flywheel. The crank assembly includes a crank axle, a first crank arm connected to a first side of the crank axle, a second crank arm connected to a second side of the crank axle, a first crank pedal connected to the first crank arm, and a second crank pedal connected to the second crank arm, a first swing arm connected to the frame, a second swing arm connected to the frame, a base connected to the frame, a first movable linkage pivotally connected to the first side of the crank axle and slidably connected to the base, a second movable linkage pivotally connected to the second side of the crank axle and slidably connected to the base. The exercise machine further includes a first longitudinal track, a second longitudinal track aligned with the first longitudinal track, a first linkage pedal connected to a first mid-region of the first movable linkage, and a second linkage pedal connected to a second mid-region of the second movable linkage. The first movable linkage connects in the first longitudinal track, and the second movable linkage connects in the second longitudinal track. The first swing arm is pivotally connected to the first movable linkage, and the second swing arm is pivotally connected to the second movable linkage. The first longitudinal track and the second longitudinal track are aligned with the seat track.

The first linkage pedal and the second linkage pedal may travel in a generally oblong path when the crank axle rotates.

The exercise machine may include a handle attached to a first cable end of the pull cable and a cable axle in communication with a second cable end.

The exercise machine may include a transmission medium connecting the cable axle to the first flywheel.

In an embodiment, an exercise machine includes a frame, a seat track of the frame, a seat movably attached to the seat of the frame, a first flywheel connected to the frame, a second flywheel connected to the frame, a pull cable in communication with the first flywheel, a crank assembly in communication with the second flywheel. The crank assembly includes a crank axle, a first crank arm connected to a first side of the crank axle, a second crank arm connected to a second side of the crank axle, a first crank pedal connected to the first crank arm, and a second crank pedal connected to the second crank arm. The exercise machine includes a crank transmission medium that transmits torque from the crank assembly to the second flywheel when the crank axle rotates, a first swing arm connected to the frame, a second swing arm connected to the frame, a base connected to the frame, a first movable linkage pivotally connected to the first side of the crank axle and slidably connected to the base, and a second movable linkage pivotally connected to the second side of the crank axle and slidably connected to the base, a first longitudinal track, a second longitudinal track aligned with the first longitudinal track, a first linkage pedal connected to a first mid-region of the first movable linkage, a second linkage pedal connected to a second mid-region of the second movable linkage, a handle attached to a first cable end of the pull cable, a cable axle in communication with a second cable end, and a pull transmission medium connecting the cable axle to the first flywheel. The first movable linkage connects in the first longitudinal track, and the second movable linkage connects in the second longitudinal track. The first swing arm is pivotally connected to the first movable linkage, and the second swing arm is pivotally connected to the second movable linkage. The first longitudinal track and the second longitudinal track are aligned with the seat track. The first linkage pedal and the second linkage pedal travel in a generally oblong path when the crank axle rotates and the first crank pedal and the second crank pedal travel in a generally circular path when the crank axle rotates.

In one embodiment, an exercise machine includes a frame, a seat track of the frame, a seat movably attached to the seat of the frame, a flywheel connected to the frame, a pull cable in communication with the flywheel, a crank assembly in communication with the flywheel, a first swing arm connected to the frame, and a second swing arm connected to the frame.

The crank assembly may include a crank axle, a first crank arm connected to a first side of the crank axle, a second crank arm connected to a second side of the crank axle, a first crank pedal connected to the first crank arm, and a second crank pedal connected to the second crank arm.

The crank assembly may include a crank wheel connected to the crank axle.

The exercise machine may include a transmission medium that transmits torque from the crank wheel to the flywheel when the crank axle rotates.

The exercise machine may include a magnetic resistance mechanism that resists movement of the flywheel.

The first crank pedal and the second crank pedal may travel in a generally circular path when the crank axle rotates.

The exercise machine may include a base connected to the frame, a first movable linkage pivotally connected to the first side of the crank axle and slidably connected to the base, and a second movable linkage pivotally connected to the second side of the crank axle and slidably connected to the base.

The base may include a first longitudinal track and a second longitudinal track aligned with the first longitudinal track. The first movable linkage may connect in the first longitudinal track, and the second movable linkage may connect in the second longitudinal track.

The first swing arm may be pivotally connected to the first movable linkage, and the second swing arm may be pivotally connected to the second movable linkage.

The exercise machine may include a first linkage pedal connected to a first mid-region of the first movable linkage and a second linkage pedal connected to a second mid-region of the second movable linkage.

The first linkage pedal and the second linkage pedal may travel in a generally oblong path when the crank axle rotates.

The first longitudinal track and the second longitudinal track may be aligned with the seat track.

The exercise machine may include a handle attached to a first cable end of the pull cable and a cable axle in communication with a second cable end.

The exercise machine may include a transmission medium connecting the cable axle to the flywheel.

In one embodiment, an exercise machine includes a frame, a seat track of the frame, a seat movably attached to the seat of the frame, a flywheel connected to the frame, a pull cable in communication with the flywheel, and a crank assembly in communication with the flywheel. The crank assembly includes a crank axle, a first crank arm connected to a first side of the crank axle, a second crank arm connected to a second side of the crank axle, a first crank pedal connected to the first crank arm, and a second crank pedal connected to the second crank arm. The exercise machine includes a first swing arm connected to the frame, a second swing arm connected to the frame, a base connected to the frame, a first movable linkage pivotally connected to the first side of the crank axle and slidably connected to the base, and a second movable linkage pivotally connected to the second side of the crank axle and slidably connected to the base, a first longitudinal track, a second longitudinal track aligned with the first longitudinal track, a first linkage pedal connected to a first mid-region of the first movable linkage, and a second linkage pedal connected to a second mid-region of the second movable linkage. The first movable linkage connects in the first longitudinal track, and the second movable linkage connects in the second longitudinal track. The first swing arm is pivotally connected to the first movable linkage, and the second swing arm is pivotally connected to the second movable linkage. The first longitudinal track and the second longitudinal track are aligned with the seat track.

The exercise machine may include a transmission medium that transmits torque from the crank assembly to the flywheel when the crank axle rotates.

The first linkage pedal and the second linkage pedal may travel in a generally oblong path when the crank axle rotates.

The exercise machine may include a handle attached to a first cable end of the pull cable and a cable axle in communication with a second cable end.

The exercise machine may include a transmission medium connecting the cable axle to the flywheel.

In one embodiment, an exercise machine includes a frame, a seat track of the frame, a seat movably attached to the seat of the frame, a flywheel connected to the frame, a pull cable in communication with the flywheel, and a crank assembly in communication with the flywheel. The crank assembly includes a crank axle, a first crank arm connected to a first side of the crank axle, a second crank arm connected to a second side of the crank axle, a first crank pedal connected to the first crank arm, and a second crank pedal connected to the second crank arm. The exercise machine includes a crank transmission medium that transmits torque from the crank assembly to the flywheel when the crank axle rotates, a first swing arm connected to the frame, a second swing arm connected to the frame, a base connected to the frame, a first movable linkage pivotally connected to the first side of the crank axle and slidably connected to the base, a second movable linkage pivotally connected to the second side of the crank axle and slidably connected to the base, a first longitudinal track, a second longitudinal track aligned with the first longitudinal track, a first linkage pedal connected to a first mid-region of the first movable linkage, a second linkage pedal connected to a second mid-region of the second movable linkage, a handle attached to a first cable end of the pull cable, a cable axle in communication with a second cable end, and a pull transmission medium connecting the cable axle to the flywheel. The first movable linkage connects in the first longitudinal track, and the second movable linkage connects in the second longitudinal track. The first swing arm is pivotally connected to the first movable linkage, and the second swing arm is pivotally connected to the second movable linkage. The first longitudinal track and the second longitudinal track are aligned with the seat track. The first linkage pedal and the second linkage pedal travel in a generally oblong path when the crank axle rotates and the first crank pedal and the second crank pedal travel in a generally circular path when the crank axle rotates.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. Often, the width of an object is transverse the object's length.

Figure 1:
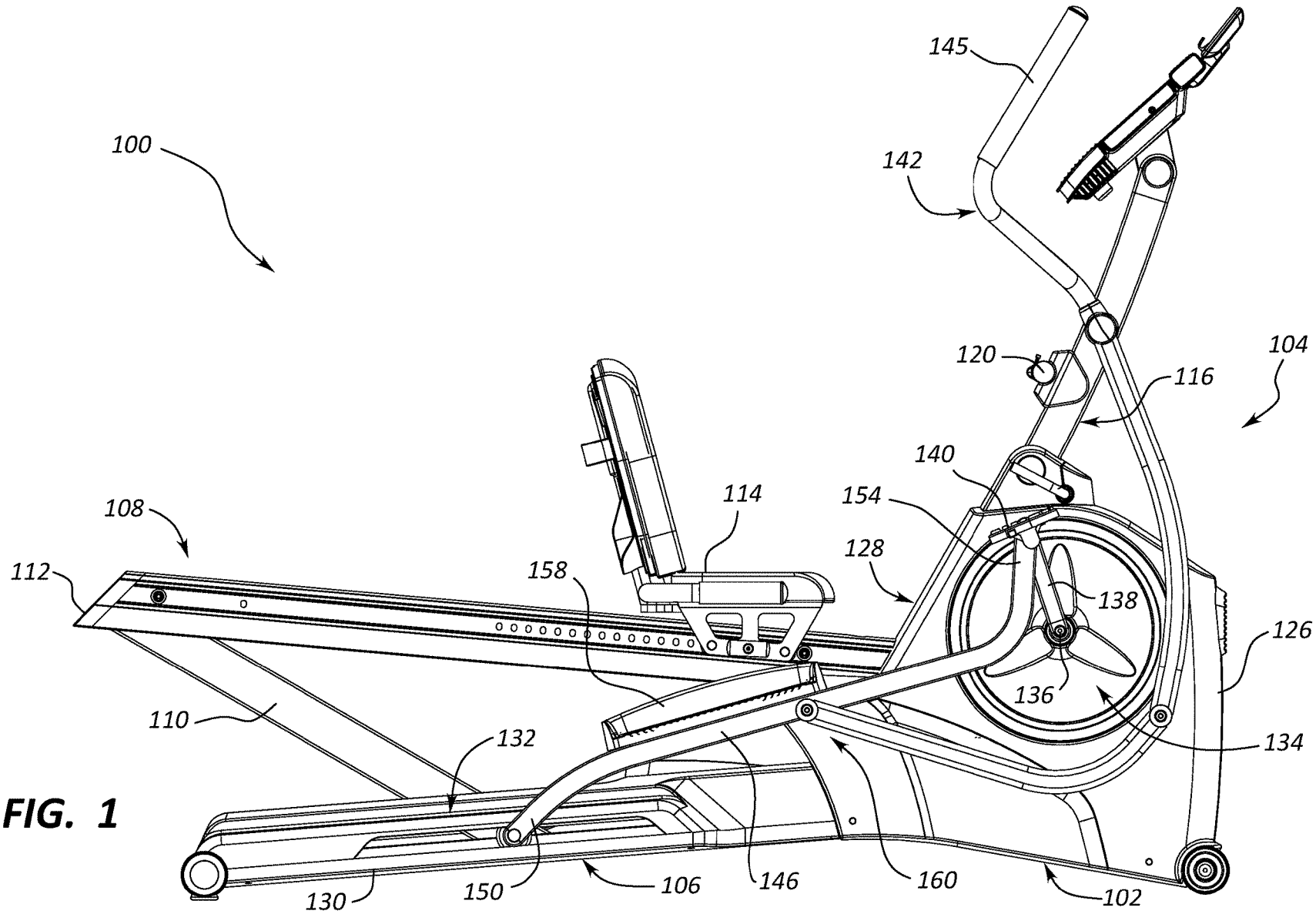
FIG. 1 illustrates a side view of an example of an exercise machine in accordance with the present disclosure.
Figure 2:
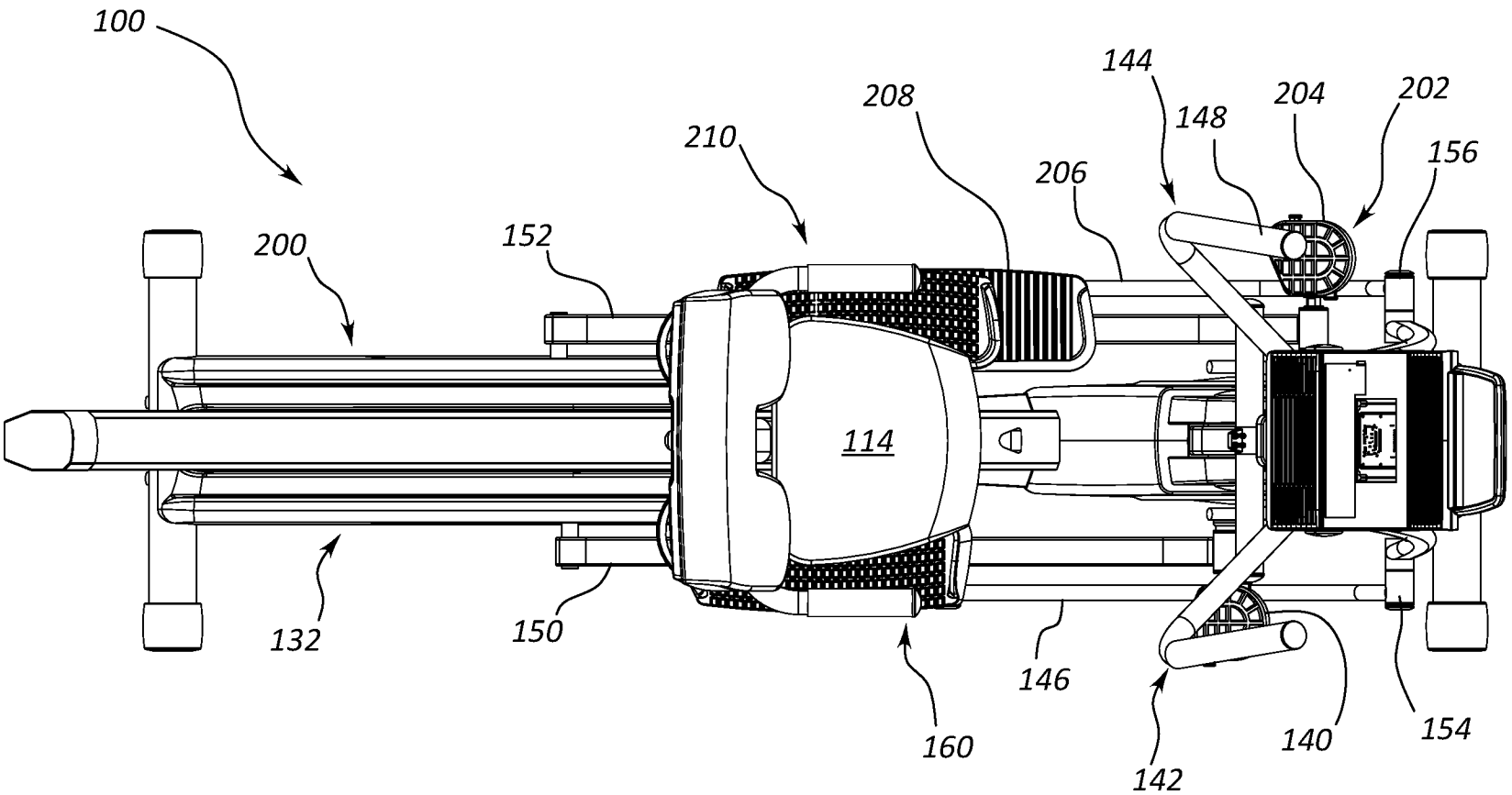
FIG. 2 illustrates a top view of an example of an exercise machine in accordance with the present disclosure.

FIGS. 1 and 2 depict an example of an exercise machine 100 with a frame 102. The frame 102 may include an upright portion 104 and a base 106. The upright portion 104 of the frame 102 can be connected to a seat track 108 that extends horizontally away from the upright portion 104. A leg 110 may extend from the base 106 and support a distal end 112 of the seat track 108. A seat 114 may be movably attached to the seat track 108 so that the seat 114 can slide along a length of the seat track 108.

The upright portion 104 may support a pull cable 116. A first end of the pull cable 116 may be attached to a handle 120, and a second end of the pull cable 116 may be attached to a resistance mechanism (not shown). In some examples, the resistance mechanism is contained within a housing 126 that is connected to the upright portion 104 of the frame 102. In those circumstances when the pull cable 116 is pulled, the resistance mechanism resists the longitudinal movement of the pull cable 116. The housing, the upright portion, or another portion of the exercise machine may include a push pad 128. A user may sit on the seat 114, and place his or her feet against the push pads 128. The user may slide along the length of the seat track 108 by extending his or her legs and/or bending his or her knees. As the user's seat 114 slides away from the upright portion 104 of the frame 102, the user may lean back and pull the pull cable 116 as part of a rowing exercise. As the user travels towards the upright portion 104 of the frame 102, the pull cable 116 may longitudinally move to return to its original position.

The base 106 may include at least one structural member 130 that is transverse the upright portion 104. In some examples, the base includes multiple structural members that are aligned with each other and also transverse the upright portion. The base 106 may include a first linkage track 132 and a second linkage track 200. In some cases, the first linkage track 132 is formed on a first side of the base 106, and the second linkage track 200 may be formed on a second side of the base 106. In other examples, the first and second linkage tracks 132, 200 are incorporated into the base 106 on a top side. The first linkage track 132 and the second linkage track 200 can be aligned with the seat track 108.

A crank assembly 134 may be included in the exercise machine 100. In some examples, the crank assembly 134 is supported by the base 106. In other examples, the crank assembly 134 is supported by a section of the upright portion 104. The crank assembly 134 may include a crank axle 136, a first crank arm 138 connected to the crank axle 136, and a second crank arm 202 connected to the crank axle 136. A first crank pedal 140 may be attached to the first crank arm 138, and a second crank pedal 204 may be attached to a second crank arm 202. When the crank axle 136 is rotated, the first crank pedal 140 and the second crank pedal 204 may travel in a generally circular path.

A first swing arm 142 may be pivotally attached to a first side of the upright portion 104, and a second swing arm 144 may be pivotally attached to a second side of the upright portion 104. A first swing handle 145 may be attached to an upper portion of the first swing arm 142, and a second swing handle 148 may be attached to an upper portion of the second swing arm 144. A bottom portion of the first swing arm 142 may be connected to a first movable linkage 146, and a bottom portion of the second swing arm 144 may be connected to a second movable linkage 206. The first movable linkage 146 may have an end 150 that slides along the length of the first linkage track 132 of the base 106, and the second movable linkage 206 may have an end 152 that slides along the length of the second linkage track 200 of the base 106. The other end 154 of the first movable linkage 146 may be connected to the first crank arm 138, and the other end 156 of the second movable linkage 206 may be connected to the second crank arm 202. A first linkage pedal 158 may be incorporated into a first mid-region 160 of the first movable linkage 146, and a second linkage pedal 208 may be incorporated into a second mid-region 210 of the second movable linkage 206. The first and second linkage pedals 158, 206 may travel in an oblong path when the crank axle 136 rotates.

Figure 3:
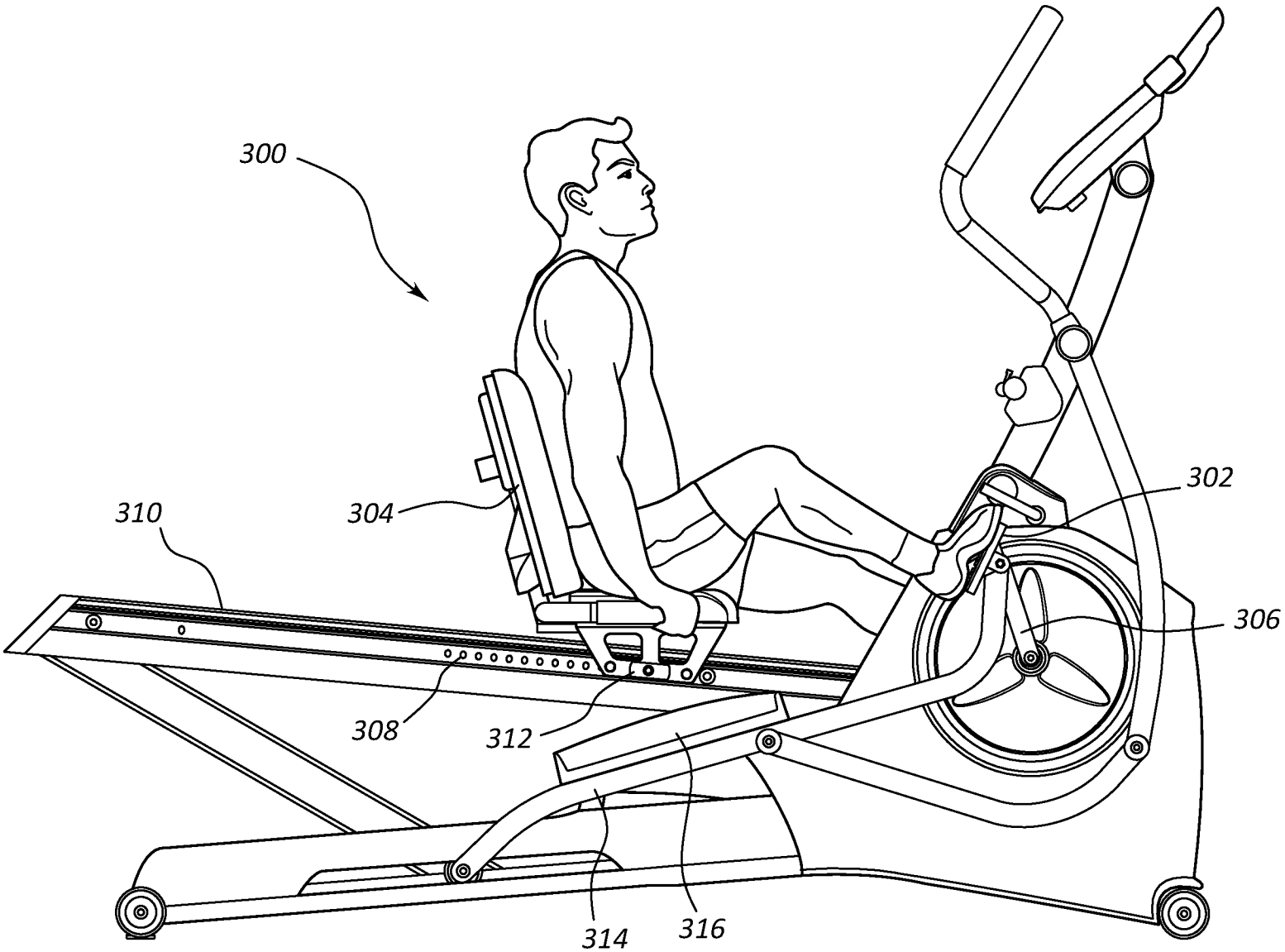
FIG. 3 illustrates a side view of an example of a user performing an exercise with an exercise machine in accordance with the present disclosure.

FIG. 3 depicts an example of a user 300 performing a cycling exercise. In this example, the user has his feet on the crank pedals 302 and the user is seated in the seat 304. As the user pushes on the crank pedals 302, the crank axle 306 moves causing the crank pedals 302 to move in a generally circular path. In this example, the seat 304 can be locked in place. Multiple openings 308 may be formed in the underside of the seat track 310. A pin 312 may be secured through one of the openings 308 to prevent the seat from sliding along the seat track 310. As the crank axle 306 is rotated, the movable linkages 314 and linkage pedals 316 move accordingly.

Figure 4:
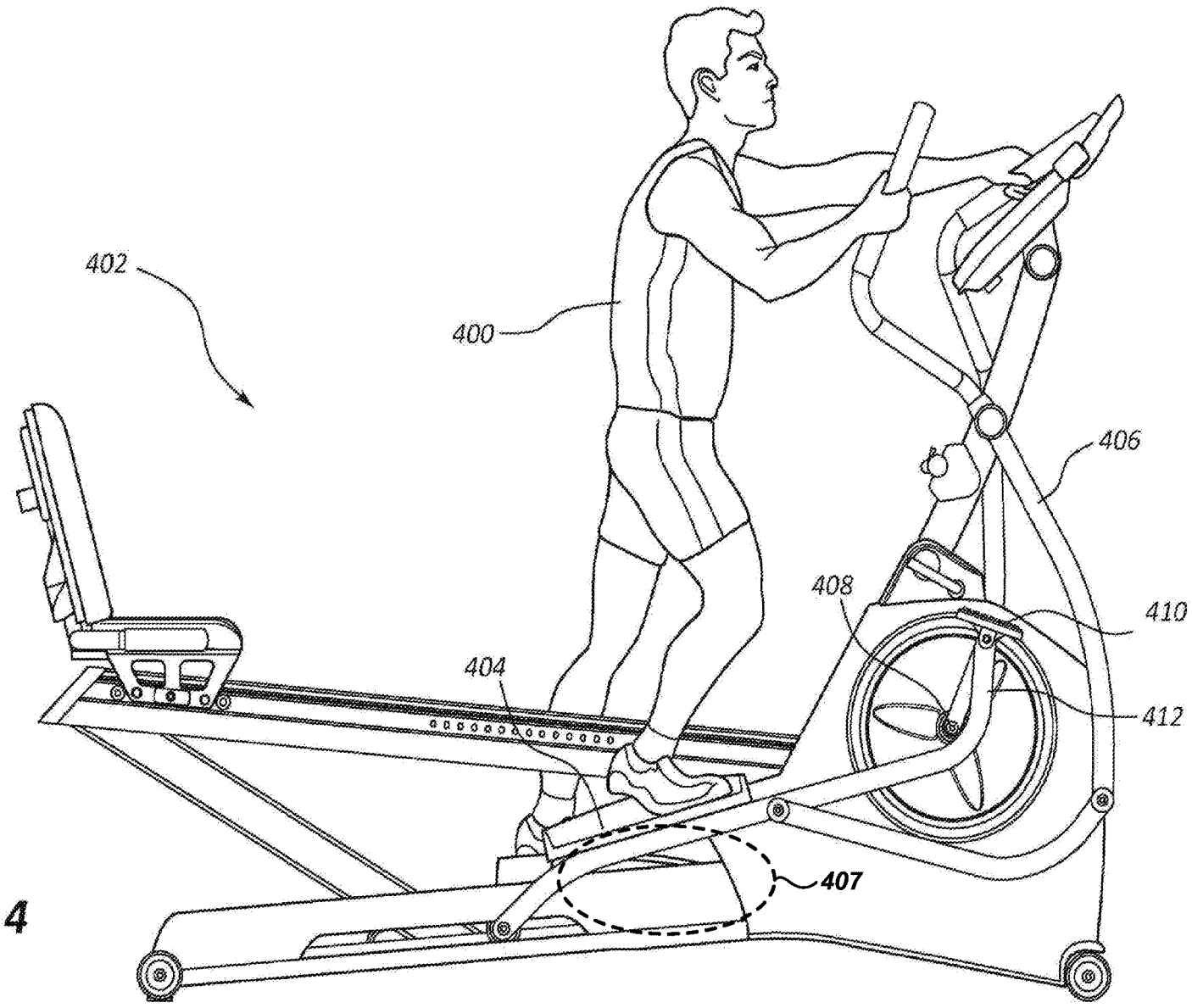
FIG. 4 illustrates a side view of an example of a user performing an exercise with an exercise machine in accordance with the present disclosure.

FIG. 4 depicts an example of a user 400 performing an elliptical training exercise with the exercise machine 402. In this example, the user is standing with his feet on the linkage pedals 404. The user may optionally support himself by holding onto the swing arms 406. As the user moves the linkage pedals 404, the linkage pedals 404 travel in an oblong path 407. In this example, as the crank axle 408 rotates, the crank pedals 410 and the crank arms 412 move accordingly.

Figure 5:
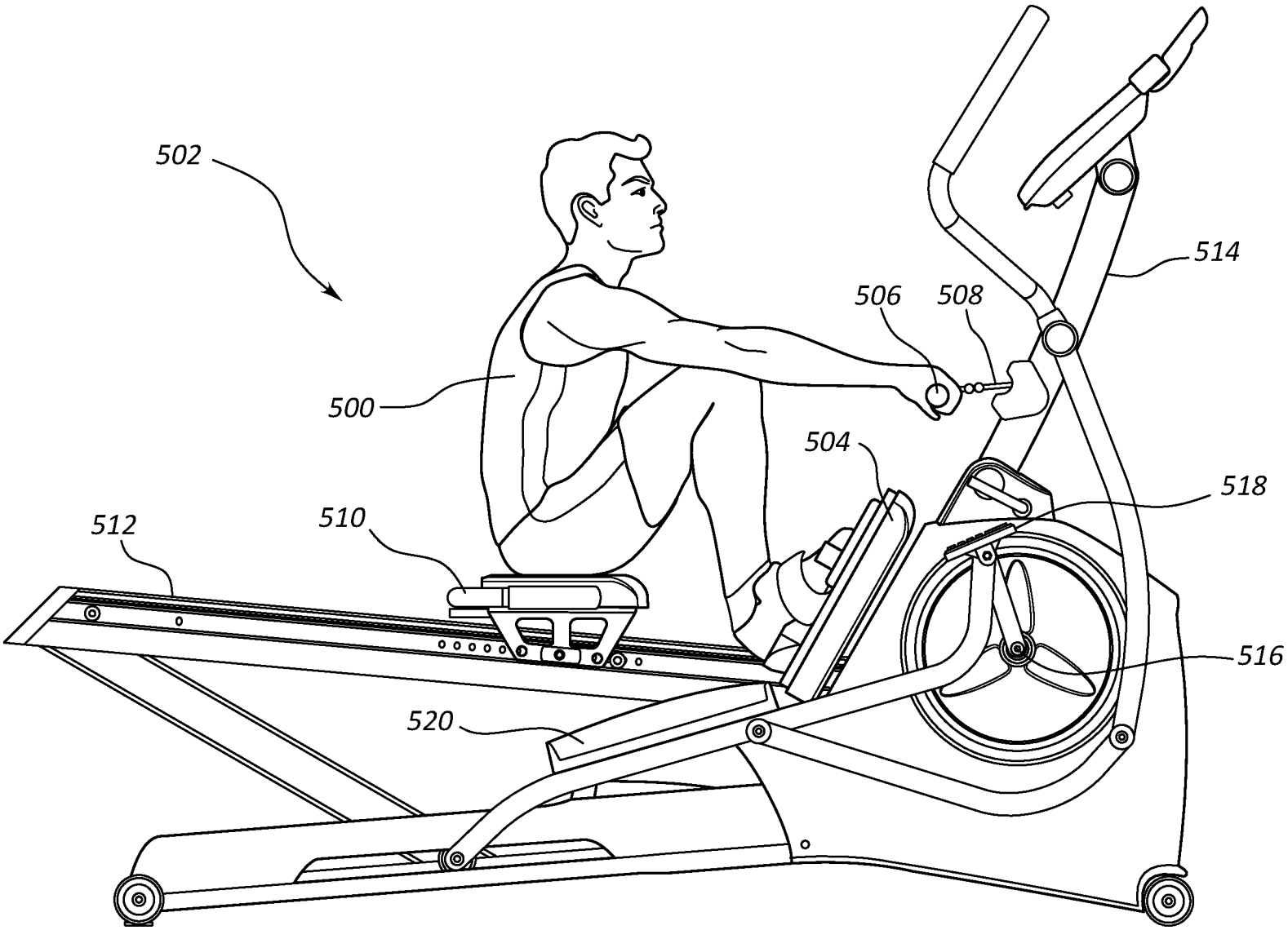
FIG. 5 illustrates a side view of an example of a user performing an exercise with an exercise machine in accordance with the present disclosure.

FIG. 5 depicts an example of a user 500 performing a rowing exercise with the exercise machine 502. In this example, the user has his feet secured against the push pads 504, holding the handle 506 of the pull cable 508, and sitting in the seat 510. As the user straightens his legs, the seat 510 slides along the seat track 512 and the pull cable 508 moves longitudinally against the resistance force of the resistance mechanism. On the return stroke, the user 500 bends his knees moving his body back towards the exercise machine's upright portion 514 and the pull cable 508 moves longitudinally to its original position. In some examples, the pull cable 508 is decoupled from the crank assembly so that the crank axle 516 and therefore the crank pedals 518 and linkage pedals 520 do not move based on the longitudinal movement of the pull cable 508.

Figure 6:
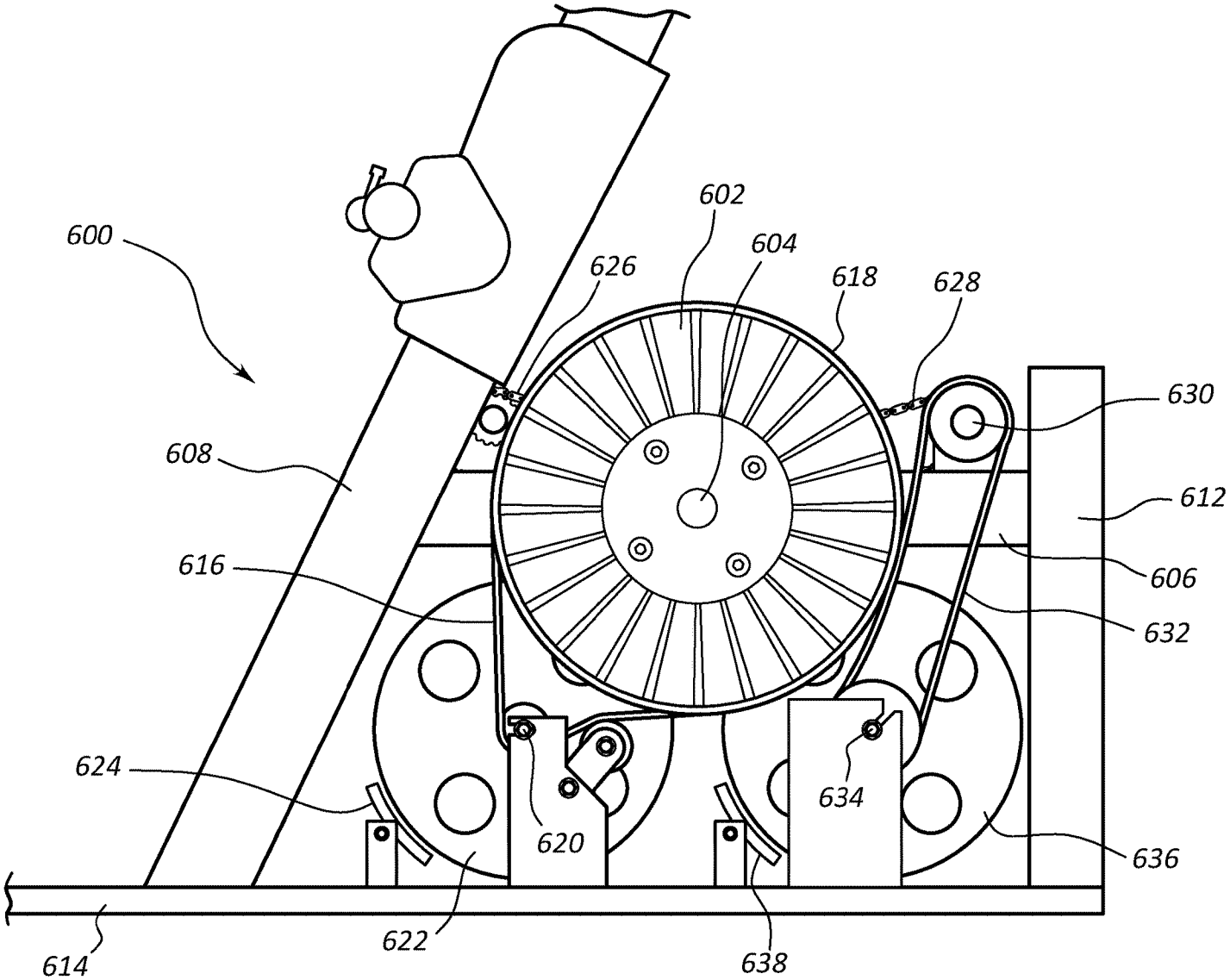
FIG. 6 illustrates a side view of an example of a resistance mechanism in an exercise machine in accordance with the present disclosure.

FIG. 6 depicts an example of the resistance mechanism 600. In this example, the resistance mechanism 600 includes a crank wheel 602 concentrically connected to the crank axle 604. The crank axle 604 is supported by a beam 606 that is attached to a frame member 608 of the upright portion and a leg 612 connected to a base member 614 of the frame.

A first transmission medium 616, such as a drive belt, chain, loop, rope, cable, band, and so forth, is secured around the circumference 618 of the crank wheel. In other examples, the first transmission medium 616 can be secured around a portion of the crank axle's circumference. The first transmission medium 616 connects the crank wheel/crank axle to a first axle 620 of a first flywheel 622. A first magnetic unit 624 may be positioned adjacent the first flywheel 622 so that the first magnetic unit 624 resists the flywheel's movement. This resistance may be transmitted back through the first transmission medium 616, and the crank axle's rotational movement is resisted. As a result, the movement of the crank pedals and the linkage pedals is also resisted.

The pull cable 626 is also routed by the frame member 608 of the upright portion. A second end 628 of the pull cable 626 is connected to a pull cable axle 630 which is supported by the beam 606, but may be connected to another portion of the exercise machine in other examples. A second transmission medium 632 connects the pull cable axle 630 to a second axle 634 of a second flywheel 636. A second magnetic unit 638 may be positioned adjacent the second flywheel 636 so that the second magnetic unit 638 resists the flywheel's movement. This resistance may be transmitted back through the second transmission medium 632 to the pull cable axle and thereby resist the longitudinal movement of the pull cable 626. In this example, the movement of the crank axle 604 and the movement of the pull cable axle 630 are independent so that movement of the one of the these axles does not cause the rotation of the other. Thus, when the pull cable is moved, the crank pedals and the linkage pedals do not move accordingly. Likewise, when the crank pedals and/or linkage pedals are moved, no additional resistance is placed on the pull cable.

Figure 7:
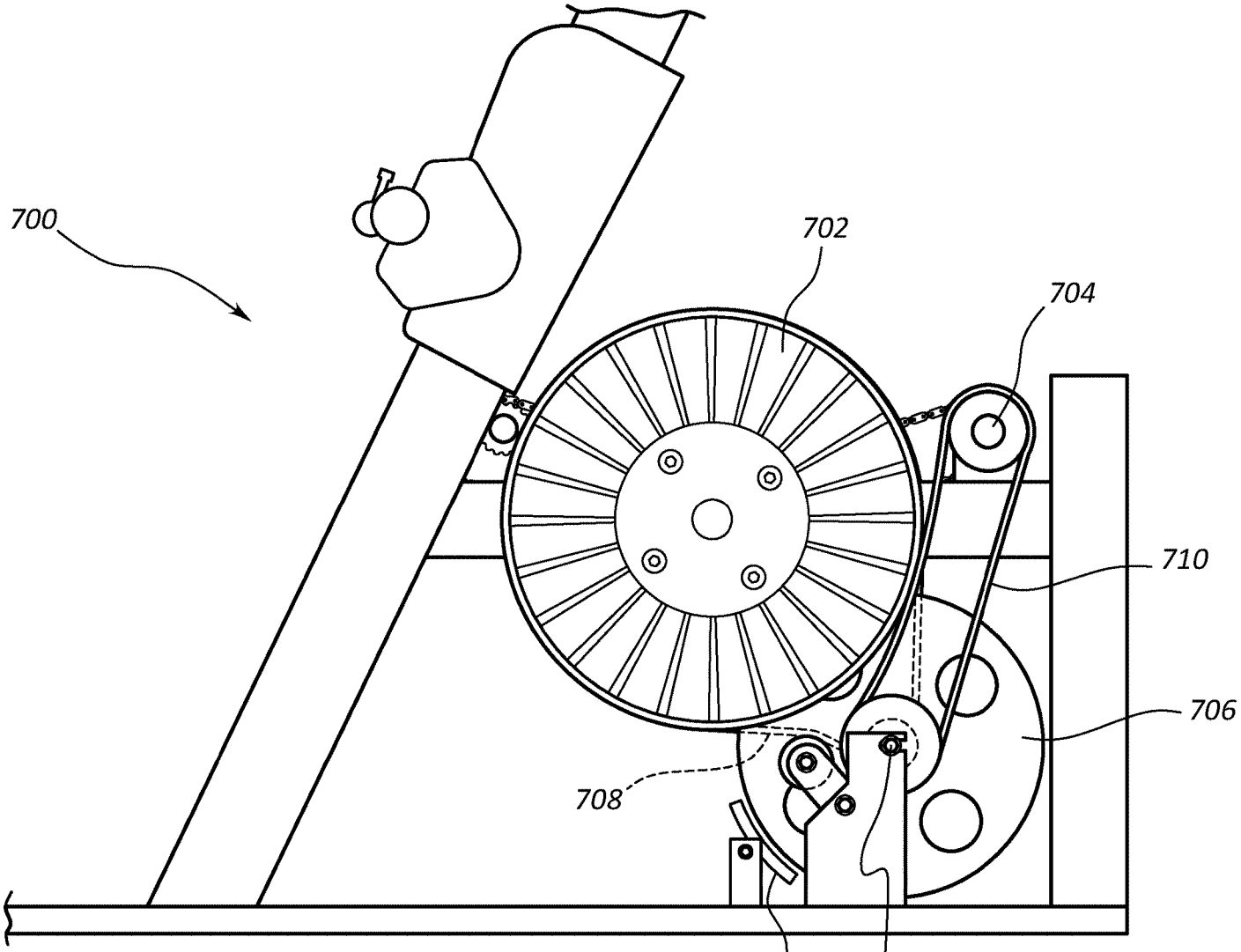
FIG. 7 illustrates a side view of an example of a resistance mechanism in an exercise machine in accordance with the present disclosure.

FIG. 7 depicts an example of a resistance mechanism 700. In this example, the crank wheel 702 and the pull cable axle 704 are connected to the same flywheel 706. In this example, the first transmission medium 708 and the second transmission medium 710 are connected to the flywheel's axle 712. The magnetic unit 714 resists movement of the flywheel 706. Thus, the movement of the pull cable and the movement of the crank pedals and linkage pedals are resisted with the same flywheel.

GENERAL DESCRIPTION

In general, the invention disclosed herein may provide users with an exercise machine that has several exercise modes. For example, the exercise machine may have a mode that allows the user to perform a rowing exercise, a cycling exercise, an elliptical exercise, another type of exercise, or combinations thereof.

In some examples, the exercise machine includes a frame. The frame may include an upright portion and a base portion. The upright portion of the frame can be connected to a seat track that extends horizontally away from the upright portion. A leg may extend vertically from the base and support a distal end of the seat track. A seat may be movably attached to the seat track so that the seat can slide along a length of the seat track.

The upright portion may support a pull cable. A first end of the pull cable may be attached to a handle, and a second end of the pull cable may be attached to a resistance mechanism. In some examples, the resistance mechanism is contained within a housing that is connected to the upright portion of the frame. In those circumstances when the pull cable is pulled, the resistance mechanism resists the longitudinal movement of the pull cable. The housing, the upright portion, or another portion of the exercise machine may include a push pad. A user may sit on the seat and place his or her feet against the push pads. The user may slide along the length of the seat track by extending his or her legs and/or bending her or her knees. As the user's seat slides away from the upright portion of the frame, the user may lean back and pull the pull cable as part of a rowing exercise. As the user travels towards the upright portion of the frame, the pull cable may longitudinally move to return to its original position.

The base may include at least one structural member that is transverse the upright portion. In some examples, the base includes multiple structural members that are aligned with each other and also transverse the upright portion. The base may include a first linkage track and a second linkage track. In some cases, the first linkage track is formed on a first side of the base, and the second linkage track may be formed on a second side of the base. In other examples, the first and second linkage tracks are incorporated into the base on a top side. The first linkage track and the second linkage track can be aligned with the seat track.

A crank assembly may be included in the exercise machine. In some examples, the crank assembly is supported by a section of the base. In other examples, the crank assembly is supported by a section of the upright portion. The crank assembly may include a crank axle, a first crank arm connected to the crank axle, and a second crank arm connected to the crank axle. A first crank pedal may be attached to the first crank arm, and a second crank pedal may be attached to a second crank arm. When the crank axle is rotated, the first crank pedal and the second crank pedal may travel in a generally circular path.

A first swing arm may be pivotally attached to a first side of the upright portion, and a second swing arm may be pivotally attached to a second side of the upright portion. A first swing handle may be attached to an upper portion of the first swing arm, and a second swing handle may be attached to an upper portion of the second swing arm. A bottom portion of the first swing arm may be connected to a first movable linkage, and a bottom portion of the second swing arm may be connected to a second movable linkage. The first movable linkage may have an end that slides along the length of the first linkage track of the base, and the second movable linkage may have an end that slides along the length of the second linkage track of the base. The other end of the first movable linkage may be connected to the first crank arm, and the other end of the second movable linkage may be connected to the second crank arm. A first linkage pedal may be incorporated into a first mid-region of the first movable linkage, and a second linkage pedal may be incorporated into a second mid-region of the second movable linkage. The first and second linkage pedals may travel in an oblong path when the crank axle rotates.

Thus, in one mode, the user may perform a rowing exercise by pulling on the pull cable while sliding his or her body along the length of the seat track in the seat. In a second mode, the user may perform an elliptical trainer exercise by standing on the linkage pedals and rotating the crank axle with the linkage pedals. In some examples, the user may hold onto the first and second swing handles during the performance of the elliptical trainer exercise. Also, the user may perform a cycling exercise by pushing the crank pedals with his or her feet. In some cases, the seat may be locked in place along the length of the seat track so that the seat cannot slide. When locked, the user may sit on the seat and move the crank pedals with his or her feet to perform the cycling exercise.

In some examples, the resistance mechanism includes a crank wheel concentrically connected to the crank axle. The crank axle may be supported by a beam that is attached to a frame member of the upright portion and a leg connected to a base member of the frame. While this example is described with the crank axle supported with a specific component of the exercise machine, the crank axle may be supported with any appropriate component of the exercise machine.

A first transmission medium, such as a drive belt, chain, loop, rope, cable, band, and so forth, may be secured around the circumference of the crank wheel. In other examples, the first transmission medium can be secured around a portion of the crank axle's circumference. The first transmission medium may connect the crank wheel/crank axle to a first axle of a first flywheel. A first magnetic unit may be positioned adjacent the first flywheel so that the first magnetic unit resists the flywheel's movement. This resistance may be transmitted back through the first transmission medium to the crank axle. Thus, the rotational movement of the crank axle is also resisted. As a result, the movement of the crank pedals and the linkage pedals is also resisted.

The pull cable may be routed by the frame member of the upright portion. A second end of the pull cable may be connected to a pull cable axle which is supported by the beam or another portion of the exercise machine in other examples. In some examples, a second transmission medium may connect the pull cable axle to a second axle of a second flywheel. In this example, a second magnetic unit may be positioned adjacent the second flywheel so that the second magnetic unit resists the flywheel's movement. This resistance may be transmitted back through the second transmission medium to the pull cable axle and thereby resist the longitudinal movement of the pull cable. In this example, the movement of the crank axle and the movement of the pull cable axle are independent, so that movement of one of the these axles does not cause the rotation of the other. Thus, when the pull cable is moved, the crank pedals and the linkage pedals do not move accordingly. Likewise, when the crank pedals and/or linkage pedals are moved, no additional resistance is placed on the pull cable.

The magnetic unit may resist the movement of its respective flywheel. In examples where the magnetic unit exhibits a consistent magnetic field, the amount of resistance applied to the flywheel may be changed by moving the magnetic unit towards or away from the flywheel. For example, the resistance applied to the flywheel may be increased by moving the magnetic unit closer to the flywheel. In other examples, the resistance applied to the flywheel may be decreased by moving the magnetic unit closer to the flywheel. In some cases, the magnetic unit may emit a variable amount of magnetic resistance by applying a varying amount of electrical power to the magnetic unit.

In other examples, the crank axle and the pull cable axle are connected to the same flywheel. In these types of examples, the first transmission medium and the second transmission medium are connected to the flywheel's axle. The magnetic unit resists movement of the flywheel. Thus, the movement of the pull cable and the movement of the crank pedals and linkage pedals are resisted with the same flywheel.

In some of these examples, longitudinal movement of the pull cable may also cause the crank pedals and the linkage pedals to travel along their respective paths. However, in other examples, the movement of the pull cable is still decoupled from the movement of the crank and linkage pedals. For example, a transmission medium connecting the crank axle to the flywheel axle may be connected with a spool assembly. The spool assembly may be connected to the flywheel axle so that when the spool assembly rotates in a first direction, the spool assembly causes the flywheel axle to rotate in the first direction. When the spool assembly rotates in a second direction with respect to the flywheel axle, the spool assembly rotates independent of the flywheel axle. As a result, when the flywheel axle rotates by a force other than the rotational force of the spool assembly, the spool assembly does not rotate. In this example, when the flywheel axle is caused to rotate by the transmission medium connected to the pull cable assembly, the spool assembly does not rotate. Likewise, the transmission medium connecting the pull cable axle to the flywheel axle can also be connected with a spool assembly so that movement of the pull cable is also independent of the crank axle's movement. In this manner, the movement of the pull cable axle and the crank axle are independent. Thus, pulling on the pull cable may not cause the crank and linkage pedals to move. Similarly, moving the crank pedals and/or linkage pedals may not apply a longitudinal force on the pull cable.

In some examples, the crank assembly does not include a crank wheel. In some of these examples, a transmission medium may connect the crank axle directly to the flywheel axle or to the circumference of the flywheel. In another example, the pull cable may be wrapped around a circumference of the flywheel so that as the handle of the pull handle is pulled, the flywheel is caused to rotate in a first direction. In other examples, a spring mechanism, a counterweight mechanism, or another type of mechanism causes the flywheel to return to its original orientation in the absence of a force from the user. In these examples, as the user reduces the pull force on the handles, the flywheel may return to its original position, ready to be rotated again in response to a pull force on the handles.

In other examples, the cable may be wrapped in a spool that is connected to the flywheel. In these examples, the spool may share a common rotational axis with the flywheel. The flywheel may rotate with the spool in a first direction when the user is pulling on the pull handle. However, the spool may rotate independent of the flywheel back to its original position as the user returns the pull handle to take up the slack in the cable. The spool may return to its original position due to a counterweight, a spring mechanism, another type of mechanism or combinations thereof. In these examples, the flywheel may remain in the orientation left by the user at the end of the user's pull. In this manner, the flywheel may rotate in just a single direction.

In some examples, the first flywheel and the second flywheel are positioned on the same rotational axle. In this example, the first and second flywheels can be positioned adjacent to one another. The first and second flywheels may be rotationally independent of each other and/or rotationally independent of the common axle. In this manner, the flywheels can rotate without affecting the momentum of the other flywheel. For example, at least one of the flywheels may be connected to the common axle with a rotational bearing that allows the flywheel to rotate independent of the common axle. In examples with a common axle, the common axle may be rotationally fixed with respect to the frame of the exercise machine.

In some cases, the seat track may include a fold joint so that the seat track may be moved upright to save space in a storage mode. The fold joint may occur at an end of the seat track proximate the upright portion of the frame, or the fold joint may be positioned in a mid-region of the seat track.

With the flywheel rotating in just a single direction, a sensor may track the number of revolutions performed by the flywheel. In some embodiments, the sensor causes a counter to be incremented up one for each rotation of the flywheel. In other embodiments, the sensor can track partial revolutions of the flywheel. Other sensors can track the magnetic resistance applied to the flywheel's rotation.

The tracked level of resistance and the revolution count can be sent to a processor within the exercise machine or remote of the exercise machine. Based on these inputs, the processor can be cause to determine the amount of calories burned during each pull and/or collectively during the course of the entire workout. Further, the force generated by each pull can be calculated as well. In some examples, a transmitter incorporated into the exercise machine may send the calorie count, the revolution count, a calculated force, a speed, a duration of the exercise, another type of information or combinations thereof to a remote device. This remote device may be a mobile device, a cloud based device, a networked device, another type of device, or combinations thereof. This information may be stored in a database. This database may be accessible to the user through the internet, a profile, a network or combinations thereof.

In some examples, other types of information can be determined using the revolution count. For example, the processor may also determine the expected remaining life of the exercise machine based on use. This number may be based, at least in part, on the number of flywheel revolutions. Further, the processor may also use the revolution count to track when maintenance should occur on the exercise machine, and send a message to the user indicating that maintenance should be performed on the exercise machine based on usage.

In some examples, the sensor is accompanied with an accelerometer. The combination of the inputs from the accelerometer and the sensor can at least aid the processor in determining the force exerted by the user during each pull, crank pedal rotation, and/or linkage pedal rotation. The processor may also track the force per pull, the average force over the course of the workout, the trends of force over the course of the workout and so forth. For example, the processor may cause a graph of force per pull to be displayed to the user. In this type of graph, the amount of force exerted by the user at the beginning of the workout verses the end of the workout may be depicted. This information may be useful to the user and/or a trainer in customizing a workout for the user.

The number of calories burned by the user per pull and/or rotation may be presented to the user in a display incorporated into the exercise machine or the display of a remote device (e.g. mobile device, laptop, etc.). In some examples, the calories for an entire workout are tracked and presented to the user. In some examples, the calorie count is presented to the user through the display, through an audible mechanism, through a tactile mechanism, through another type of sensory mechanism or combinations thereof.

In some cases, a console is connected to the upright structure. The console may include a display, an input mechanism for controlling various features and/or operational controls of the exercise machine, an energy efficiency indicator, a speaker, a fan, another component of the exercise machine, or combinations thereof.

The console may locate the input mechanism within a convenient reach of the user to control the operating parameters of the exercise machine. For example, the control console may include controls to adjust the strength of the resistance mechanism, adjust a volume of a speaker integrated into the exercise machine, adjust an incline angle of the seat track, select an exercise setting, control a timer, change a view on a display of the control console, monitor the user's heart rate or other physiological parameters during the workout, perform other tasks, or combinations thereof. Buttons, levers, touch screens, voice commands, or other mechanisms may be incorporated into the console incorporated into the exercise machine and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The console assembly may further include a pair of handles that the user may grip during the performance of an exercise. For example, the user may grip the handles attached to the console assembly when the user is in the upright position. A pair of handles incorporated into the seat may be within a convenient arms reach for the user while performing an exercise in the cycling mode. While the examples above have described the handles/arm supports that the user can used during the performance of different exercises in the exercise machine's different exercise modes, the user may grip any of the handles/arm supports within a convenient reach of the user and/or desirable by the user.

In some cases, at least some of the information used to determine the calorie burn is based on a user profile that contains personal information about the user, such as height, weight, age, gender, health conditions, body composition, other types of personal information, or combinations thereof. The personal information may inputted into the console of the exercise machine. In other examples, the console may be in communication with a remote device that contains the user profile. For example, the console may be in wireless communication with a personal computer, a mobile device, a datacenter, a website, a network device, another type of device, or combinations thereof that contain at least one item of personal information about the user.

In some examples, the console may be in communication with a remote device that operates a fitness tracking program. In this example, some of the personal information may be received from the fitness tracking program. Also, in some cases, the console may send information about the user's workout to the fitness tracking program. This workout information may include the type and duration of the exercise, the resistance settings, the estimated number of calories burned, other types of information, or combinations thereof.

While the examples above have been described with reference to specific structures, the exercise machine may include any appropriate type of structure consistent with the principles described herein. For example, the specific linkage connection points and the swing arm arrangements may vary while still providing an exercise machine that includes modes for cycling, elliptical training, and/or rowing. Also, in some examples, the movable linkages are connected to the crank assembly at a different location than the crank arms. Additionally, the movable linkages may be connected to a rear crank mechanism rather than a linear track at the movable linkages' rear ends. Further, the linkage tracks may be located in a different location of the exercise machine than in the exercise machine's base. Further, the seat track may be positioned at any appropriate angle including a downward angle, an upward angle, a level angle, another type of angle, or combinations thereof.

What is claimed is:

1. An exercise machine, comprising:
- a frame;
- a seat track disposed on the frame;
- a seat movably attached to the seat track;
- a first flywheel connected to the frame at a front of the frame;
- a second flywheel connected to the frame at the front of the frame;
- a crank assembly in communication with the first flywheel;
- a first crank pedal connected to the crank assembly;
- a second crank pedal connected to the crank assembly;
- a pull cable in communication with the second flywheel;
- a handle attached to a first cable end of the pull cable;
- a cable axle in communication with a second cable end of the pull cable;
- a first linkage pedal;
- a second linkage pedal;
- a first swing arm connected to the frame and the first linkage pedal; and
- a second swing arm connected to the frame and the second linkage pedal.

2. The exercise machine of claim 1, further comprising a first magnetic resistance mechanism associated with the first flywheel, wherein the first magnetic resistance mechanism is configured to resist movement of the first flywheel.

3. The exercise machine of claim 2, further comprising a second magnetic resistance mechanism associated with the second flywheel, wherein the second magnetic resistance mechanism is configured to resist movement of the second flywheel.

4. The exercise machine of claim 1, wherein the crank assembly comprises:
- a crank axle;
- a first crank arm connected to a first side of the crank axle;
- a second crank arm connected to a second side of the crank axle;
- the first crank pedal connected to the first crank arm; and
- the second crank pedal connected to the second crank arm.

5. The exercise machine of claim 4, wherein the crank assembly further comprises a crank wheel connected to the crank axle.

6. The exercise machine of claim 5, further comprising a transmission medium configured to transmit torque from the crank wheel to the first flywheel when the crank axle rotates.

7. The exercise machine of claim 4, wherein the first crank pedal and the second crank pedal travel in a generally circular path when the crank axle rotates.

8. The exercise machine of claim 4, further comprising:
a base connected to the frame;
a first movable linkage pivotally connected to the first side of the crank axle and slidably connected to the base; and
a second movable linkage pivotally connected to the second side of the crank axle and slidably connected to the base.

9. The exercise machine of claim 8, wherein the base comprises:
a first linkage track; and
a second linkage track aligned with the first linkage track;
wherein the first movable linkage connects in the first linkage track, and the second movable linkage connects in the second linkage track.

10. The exercise machine of claim 9, wherein the first swing arm is pivotally connected to the first movable linkage, and the second swing arm is pivotally connected to the second movable linkage.

11. The exercise machine of claim 9, wherein the first linkage track and the second linkage track are aligned with the seat track.

12. The exercise machine of claim 8, further comprising:
the first linkage pedal connected to a mid-region of the first movable linkage; and
the second linkage pedal connected to a mid-region of the second movable linkage.

13. The exercise machine of claim 12, wherein the first linkage pedal and the second linkage pedal travel in a generally oblong path when the crank axle rotates.

14. The exercise machine of claim 1, further comprising a transmission medium connecting the cable axle to the second flywheel.

15. An exercise machine, comprising:
a frame including a housing at one side of the frame;
a seat track disposed on the frame;
a seat movably attached to the seat track of the frame;
a first flywheel connected to the frame and contained within the housing;
a second flywheel connected to the frame and contained within the housing;
a crank assembly in communication with the first flywheel, the crank assembly including:
a crank axle;
a first crank arm connected to a first side of the crank axle;
a second crank arm connected to a second side of the crank axle;
a first crank pedal connected to the first crank arm; and
a second crank pedal connected to the second crank arm;
a pull cable in communication with the second flywheel;
a first swing arm connected to the frame;
a second swing arm connected to the frame;
a base connected to the frame;
a first movable linkage pivotally connected to the first side of the crank axle and slidably connected to the base;
a second movable linkage pivotally connected to the second side of the crank axle and slidably connected to the base;
a first linkage track;
a second linkage track aligned with the first linkage track;
a handle attached to a first cable end of the pull cable;
a cable axle in communication with a second cable end of the pull cable;
a first linkage pedal connected to a mid-region of the first movable linkage; and
a second linkage pedal connected to a mid-region of the second movable linkage;
wherein the first movable linkage connects in the first linkage track, and the second movable linkage connects in the second linkage track;
wherein the first swing arm is pivotally connected to the first movable linkage, and the second swing arm is pivotally connected to the second movable linkage; and
wherein the first linkage track and the second linkage track are aligned with the seat track.

16. The exercise machine of claim 15, wherein the first linkage pedal and the second linkage pedal travel in a generally oblong path when the crank axle rotates.

17. The exercise machine of claim 15, further comprising a transmission medium connecting the cable axle to the second flywheel.

18. An exercise machine, comprising:
a frame including an upright portion at a front of the frame and a base;
a seat track disposed on the frame and extending horizontally away from the upright portion, wherein a distal end of the seat track is supported by a leg;
a seat movably attached to the seat track of the frame;
a first flywheel connected to the frame and connected to the upright portion;
a second flywheel connected to the frame and connected to the upright portion;
a crank assembly in communication with the first flywheel, wherein the crank assembly includes:
a crank axle;
a first crank arm connected to a first side of the crank axle;
a second crank arm connected to a second side of the crank axle;
a first crank pedal connected to the first crank arm;
a second crank pedal connected to the second crank arm; and
a crank transmission medium that transmits torque from the crank assembly to the first flywheel when the crank axle rotates;
a pull cable in communication with the second flywheel and supported by the upright portion;
a first swing arm connected to the frame;
a second swing arm connected to the frame;
the base connected to the frame;
a first movable linkage pivotally connected to the first side of the crank axle and slidably connected to the base;
a second movable linkage pivotally connected to the second side of the crank axle and slidably connected to the base;
a first linkage track;
a second linkage track aligned with the first linkage track;
a first linkage pedal connected to a mid-region of the first movable linkage; and
a second linkage pedal connected to a mid-region of the second movable linkage;
a handle attached to a first cable end of the pull cable;
a cable axle in communication with a second cable end of the pull cable;
a pull transmission medium connecting the cable axle to the second flywheel;
wherein the first movable linkage connects in the first linkage track, and the second movable linkage connects in the second linkage track;
wherein the first swing arm is pivotally connected to the first movable linkage, and the second swing arm is pivotally connected to the second movable linkage; and wherein the first linkage track and the second linkage track are aligned with the seat track; and wherein the first linkage pedal and the second linkage pedal travel in a generally oblong path when the crank axle rotates and the first crank pedal and the second crank pedal travel in a generally circular path when the crank axle rotates.

* * * * *